US010684046B2

(12) United States Patent
Ishiyama et al.

(10) Patent No.: US 10,684,046 B2
(45) Date of Patent: Jun. 16, 2020

(54) REFRIGERATION CYCLE APPARATUS IN WHICH A LUBRICATING OIL CIRCULATES TOGETHER WITH REFRIGERANT

(71) Applicant: Mitsubishi Electric Corporation, Tokyo (JP)

(72) Inventors: Hiroki Ishiyama, Tokyo (JP); Yusuke Shimazu, Tokyo (JP); Satoru Yanachi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/762,843

(22) PCT Filed: Nov. 20, 2015

(86) PCT No.: PCT/JP2015/082787
§ 371 (c)(1),
(2) Date: Mar. 23, 2018

(87) PCT Pub. No.: WO2017/085886
PCT Pub. Date: May 26, 2017

(65) Prior Publication Data

US 2018/0283746 A1 Oct. 4, 2018

(51) Int. Cl.
*F25B 23/00* (2006.01)
*F25B 31/00* (2006.01)
(Continued)

(52) U.S. Cl.
CPC ..... *F25B 31/002* (2013.01); *F25B 1/00* (2013.01); *F25B 31/00* (2013.01); *F25B 40/06* (2013.01);
(Continued)

(58) Field of Classification Search
CPC ..... F25B 31/002; F25B 31/004; F25B 2400/0403; F25B 2400/0411; F25B 2400/05; F25B 2400/054; F25B 2600/15
See application file for complete search history.

(56) References Cited

U.S. PATENT DOCUMENTS 3,913,347 A * 10/1975 Stevens ..... F25B 49/02 62/209
5,369,958 A 12/1994 Kasai et al.
(Continued)

FOREIGN PATENT DOCUMENTS

JP H10-226225 A 8/1998
JP 2000-329415 A 11/2000
(Continued)

OTHER PUBLICATIONS

International Search Report of the International Searching Authority dated Feb. 2, 2016 for the corresponding international application No. PCT/JP2015/082787 (and English translation).
(Continued)

*Primary Examiner* — Edward F Landrum
*Assistant Examiner* — Daniel C Comings
(74) *Attorney, Agent, or Firm* — Posz Law Group, PLC

(57) ABSTRACT

A refrigeration cycle apparatus includes: a compressor; a condenser; an expansion valve; an evaporator; and a control device. The compressor compresses refrigerant. The condenser condenses the refrigerant output from the compressor. The expansion valve decompresses the refrigerant output from the condenser. The evaporator evaporates the refrigerant output from the expansion valve for output to the compressor. In the case of stopping the compressor, the control device executes control for increasing a degree of superheat of the refrigerant output from the evaporator to the compressor, and then stops the compressor.

8 Claims, 17 Drawing Sheets

(51) Int. Cl.

| | |
|---|---|
| ***F25B 49/02*** | (2006.01) |
| ***F25B 1/00*** | (2006.01) |
| ***F25B 41/00*** | (2006.01) |
| ***F25B 43/02*** | (2006.01) |
| ***F25B 40/06*** | (2006.01) |

(52) U.S. Cl.
CPC ..... *F25B 41/00* (2013.01); *F25B 43/02* (2013.01); *F25B 49/02* (2013.01); *F25B 31/004* (2013.01); *F25B 2341/06* (2013.01); *F25B 2400/0403* (2013.01); *F25B 2400/0411* (2013.01); *F25B 2500/16* (2013.01); *F25B 2600/0251* (2013.01); *F25B 2600/2501* (2013.01); *F25B 2600/2513* (2013.01); *F25B 2700/19* (2013.01); *F25B 2700/21* (2013.01)

(56) References Cited

U.S. PATENT DOCUMENTS

| | | | | |
|---|---|---|---|---|
| 2012/0318013 | A1 | 12/2012 | Hozumi et al. | |
| 2013/0213064 | A1* | 8/2013 | Gomes | F25B 5/02 62/115 |
| 2014/0083126 | A1* | 3/2014 | Shimazu | F25B 41/06 62/324.6 |
| 2014/0230476 | A1 | 8/2014 | Yura et al. | |
| 2015/0314668 | A1* | 11/2015 | Suzuki | F25B 1/10 62/160 |

FOREIGN PATENT DOCUMENTS

| | | | |
|---|---|---|---|
| JP | 2001-153477 | A | 6/2001 |
| JP | 3339040 | B2 | 10/2002 |
| JP | 2004-116794 | A | 4/2004 |
| JP | 2012-072939 | A | 4/2012 |
| JP | 2013-140010 | A | 7/2013 |
| WO | 2014084343 | A1 | 6/2014 |

OTHER PUBLICATIONS

Extended European Search Report dated Jul. 30, 2018 issued in the corresponding EP application No. 15908825.1.
Office Action dated Oct. 31, 2019 issued in the corresponding CN application No. 201580084851.1 ( English translation attached).
Korean Office Action dated May 30, 2019 issued in the corresponding KR application No. 10-2018-7011907 ( English translation attached).
Australian Office Action dated May 3, 2019 issued in the corresponding AU application No. 2015415001.

* cited by examiner

REFRIGERATION CYCLE APPARATUS IN WHICH A LUBRICATING OIL CIRCULATES TOGETHER WITH REFRIGERANT

CROSS REFERENCE TO RELATED APPLICATION

This application is a U.S. national stage application of PCT/JP2015/082787 filed on Nov. 20, 2015, the contents of which are incorporated herein by reference.

TECHNICAL FIELD

The present invention relates to a refrigeration cycle apparatus and a method for controlling a refrigeration cycle apparatus, and particularly to a refrigeration cycle apparatus in which a lubricating oil circulates together with refrigerant, and a method for controlling the refrigeration cycle apparatus.

BACKGROUND ART

Japanese Patent Laying-Open No. 2013-140010 (PTD 1) discloses a refrigeration apparatus including a compressor, a heat radiator (condenser), an electric valve (expansion valve), and an evaporator. This refrigeration apparatus further includes a crankcase heater configured to heat a lubricating oil in the compressor, and a control device configured to control the crankcase heater. The control device controls the crankcase heater such that an oil temperature of the lubricating oil in the compressor reaches an oil temperature target value obtained by adding a prescribed temperature to a saturation temperature of refrigerant in the compressor, while the compressor remains stopped. The prescribed temperature is set such that an oil concentration or oil viscosity at the tune of dissolution equilibrium with respect to a pressure of the refrigerant falls within a prescribed set range.

According to this refrigeration apparatus, an appropriate oil concentration or oil viscosity of the lubricating oil in the compressor can be maintained easily and the standby power can be reduced (refer to PTD 1).

CITATION LIST

Patent Document

PTD 1: Japanese Patent Laying-Open No. 2013-140010

SUMMARY OF INVENTION

Technical Problem

A lubricating oil (hereinafter also simply referred to as "oil") is present in a compressor in order to ensure the lubricity of the compressor. While the compressor remains stopped, refrigerant in the compressor condenses to liquid refrigerant, and the liquid refrigerant dissolves in the oil in the compressor. When the operation of the compressor is started, a mixed liquid of the liquid refrigerant and the oil is taken to a refrigerant circuit together with a flow of gas refrigerant output from the compressor to the refrigerant circuit. Then, the oil taken from the compressor to the refrigerant circuit as the mixed liquid circulates through the refrigerant circuit together with the refrigerant, and returns to the compressor.

While the compressor remains stopped, the refrigerant condenses to the liquid refrigerant in the compressor as described above, and thus, a liquid level (the oil and the liquid refrigerant) in the compressor rises. When the operation of the compressor is started with the liquid level being high, a large amount of mixed liquid including the oil is taken from the compressor to the refrigerant circuit. In addition, while the compressor remains stopped, the liquid refrigerant dissolves in the oil in the compressor as described above, and thus, an oil concentration in the compressor decreases. Therefore, at the start of operation of the compressor, the large amount of mixed liquid is taken from the compressor to the refrigerant circuit and the oil concentration in the compressor is also low, and thus, poor lubrication of the compressor may occur.

The refrigeration apparatus described in PTD 1 is useful because an appropriate oil concentration or oil viscosity of the lubricating oil in the compressor can be maintained while the compressor remains stopped. However, the above-described poor lubrication that may occur at the start of operation of the compressor cannot be suppressed.

The present invention has been made in light of the above-described problem and an object of the present invention is to increase an amount of oil returning to a compressor at the start of operation of the compressor in order to suppress poor lubrication of the compressor, in a refrigeration cycle apparatus in which a lubricating oil circulates together with refrigerant.

Solution to Problem

A refrigeration cycle apparatus according to the present invention includes: a compressor; a condenser; an expansion valve; an evaporator; and a controller. The compressor is configured to compress refrigerant. The condenser is configured to condense the refrigerant output from the compressor. The expansion valve is configured to decompress the refrigerant output from the condenser. The evaporator is configured to evaporate the refrigerant output from the expansion valve for output to the compressor. The controller is configured to execute control for increasing a degree of superheat of the refrigerant output from the evaporator to the compressor, and then to stop the compressor.

Advantageous Effects of Invention

In the refrigeration cycle apparatus according to the present invention, the control for increasing the degree of superheat of the refrigerant output from the evaporator to the compressor is executed before the compressor stops. As a result, a region of a gas single phase in the evaporator increases, and an oil concentration and an oil viscosity in the evaporator increase. When the oil viscosity in the evaporator increases, a mixed liquid of liquid refrigerant and oil taken to a refrigerant circuit becomes less likely to flow in the evaporator, and an amount of oil staying in the evaporator increases. The compressor stops after execution of the above-described control.

Therefore, according to this refrigeration cycle apparatus, the oil staying in the evaporator when the compressor stops is supplied to the compressor at the start of operation of the compressor, and thus, an amount of oil returning to the compressor increases at the start of operation of the compressor. As a result, oil depletion in the compressor that may occur at the start of operation of the compressor can be suppressed and the operational reliability of the compressor can be improved.

DESCRIPTION OF EMBODIMENTS

Figure 1:
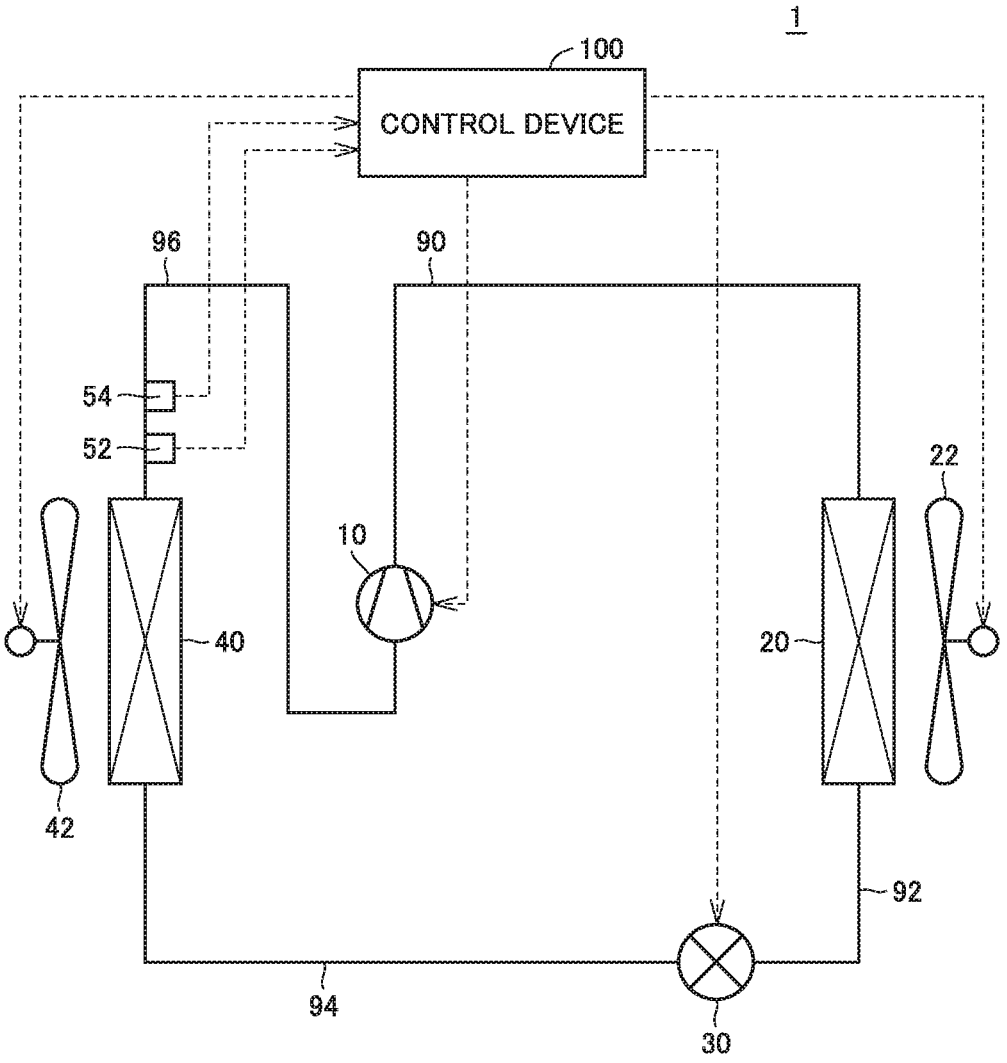
FIG. 1 is an overall configuration diagram of a refrigeration cycle apparatus according to a first embodiment of the present invention.

Embodiments of the present invention will be described in detail hereinafter with reference to the drawings. While a plurality of embodiments will be described below, an appropriate combination of features described in each of the embodiments is contemplated as of the filing of the original application. In the drawings, identical or corresponding portions are designated by identical reference characters and description thereof will not be repeated.

First Embodiment (Configuration of Refrigeration Cycle Apparatus)

FIG. 1 is an overall configuration diagram of a refrigeration cycle apparatus according to a first embodiment of the present invention. Referring to FIG. 1, a refrigeration cycle apparatus 1 includes a compressor 10, a condenser 20, a condenser fan 22, an expansion valve 30, an evaporator 40, an evaporator fan 42, and pipes 90, 92, 94, and 96. Refrigeration cycle apparatus 1 further includes a pressure sensor 52, a temperature sensor 54 and a control device 100.

Pipe 90 connects compressor 10 and condenser 20. Pipe 92 connects condenser 20 and expansion valve 30. Pipe 94 connects expansion valve 30 and evaporator 40. Pipe 96 connects evaporator 40 and compressor 10.

Compressor 10 compresses refrigerant sucked from pipe 96 and outputs the refrigerant to pipe 90. Compressor 10 is configured to be capable of changing an operation frequency in accordance with a control signal received from control device 100. By changing the operation frequency of compressor 10, an output of compressor 10 is adjusted. Various types of compressors can be used as compressor 10, and a compressor of rotary type, of reciprocating type, of scroll type, of screw type or the like may, for example, be used.

Condenser 20 condenses the refrigerant output from compressor 10 to pipe 90, and outputs the refrigerant to pipe 92. Condenser 20 is configured such that high-temperature and high-pressure superheated vapor (refrigerant) output from compressor 10 performs heat exchange (heat radiation) with the outdoor air. As a result of this heat exchange, the refrigerant is condensed to a liquid. Condenser fan 22 is adjacent to condenser 20 and is configured to be capable of adjusting a rotation speed in accordance with a control signal received from control device 100. By changing the rotation speed of condenser fan 22, an amount of heat exchange between the refrigerant and the outdoor air in condenser 20 can be adjusted.

Expansion valve 30 decompresses the refrigerant output from condenser 20 to pipe 92, and outputs the refrigerant to pipe 94. Expansion valve 30 is configured to be capable of adjusting an opening degree in accordance with a control signal received from control device 100. When the opening degree of expansion valve 30 is changed in a closing direction, a pressure of the refrigerant on the outlet side of expansion valve 30 decreases and a degree of dryness of the refrigerant increases. On the other hand, when the opening degree of expansion valve 30 is changed in an opening direction, the pressure of the refrigerant on the outlet side of expansion valve 30 increases and the degree of dryness of the refrigerant decreases.

Evaporator 40 evaporates the refrigerant output from expansion valve 30 to pipe 94, and outputs the refrigerant to pipe 96. Evaporator 40 is configured such that the refrigerant decompressed by expansion valve 30 performs heat exchange (heat absorption) with the outdoor air. As a result of this heat exchange, the refrigerant evaporates into superheated vapor. Evaporator fan 42 is adjacent to evaporator 40 and is configured to be capable of adjusting a rotation speed in accordance with a control signal received from control device 100. By changing the rotation speed of evaporator fan 42, an amount of heat exchange between the refrigerant and the outdoor air in evaporator 40 can be adjusted.

Pressure sensor 52 detects a pressure of the refrigerant at an outlet of evaporator 40, and outputs the detection value to control device 100. Temperature sensor 54 detects a temperature of the refrigerant at the outlet of evaporator 40, and outputs the detection value to control device 100.

Control device 100 includes a CPU (Central Processing Unit), a storage device, an input/output buffer and the like (all are not shown), and controls the devices in refrigeration cycle apparatus 1. This control is not limited to processing by software and can also be implemented by dedicated hardware (electronic circuit).

As main control by control device 100, control device 100 controls operation of compressor 10 in response to an instruction to operate compressor 10 and stop of compressor 10 in response to an instruction to stop compressor 10. In addition, control device 100 controls the operation frequency of compressor 10, the opening degree of expansion valve 30, the rotation speed of condenser fan 22, and the rotation speed of evaporator fan 42 so as to allow refrigeration cycle apparatus 1 to offer the desired performance.

Furthermore, control device 100 calculates a degree of superheat at the outlet of evaporator 40 based on the values of detection by pressure sensor 52 and temperature sensor 54 provided at the outlet of evaporator 40. Specifically, using a pressure-temperature map or the like indicating a relation between a saturation pressure of the refrigerant and a saturation gas temperature, control device 100 estimates a saturation gas temperature Tg based on the pressure at the outlet of evaporator 40 detected by pressure sensor 52. Then, control device 100 subtracts saturation gas temperature Tg from a temperature Teo at the outlet of evaporator 40 detected by temperature sensor 54, to thereby calculate the degree of superheat at the outlet of evaporator 40.

Furthermore, in the case of stopping compressor 10, control device 100 executes control for increasing the degree of superheat at the outlet of evaporator 40, and then, stops compressor 10. Since such control is executed before compressor 10 is stopped, a lubricating oil stays in evaporator 40 and an amount of oil returning to compressor 10 increases when the operation of compressor 10 is started next. This will be described in detail below.

The lubricating oil is present, in compressor 10 in order to ensure the lubricity of compressor 10. While compressor 10 remains stopped, the refrigerant in compressor 10 condenses to liquid refrigerant, and the liquid refrigerant dissolves in the oil in compressor 10. When the operation of compressor 10 is started, a mixed liquid of the liquid refrigerant and the oil is taken to a refrigerant circuit together with a flow of gas refrigerant output from compressor 10 to the refrigerant circuit. Then, the oil taken from compressor 10 to the refrigerant circuit as the mixed liquid circulates through the refrigerant circuit together with the refrigerant, and returns to compressor 10.

While compressor 10 remains stopped, the refrigerant condenses to the liquid refrigerant in compressor 10, and thus, a liquid level (the oil and the liquid refrigerant) in compressor 10 rises. When the operation of compressor 10 is started with the liquid level being high, a large amount of mixed liquid including the oil is taken from compressor 10 to the refrigerant circuit.

Figure 2:
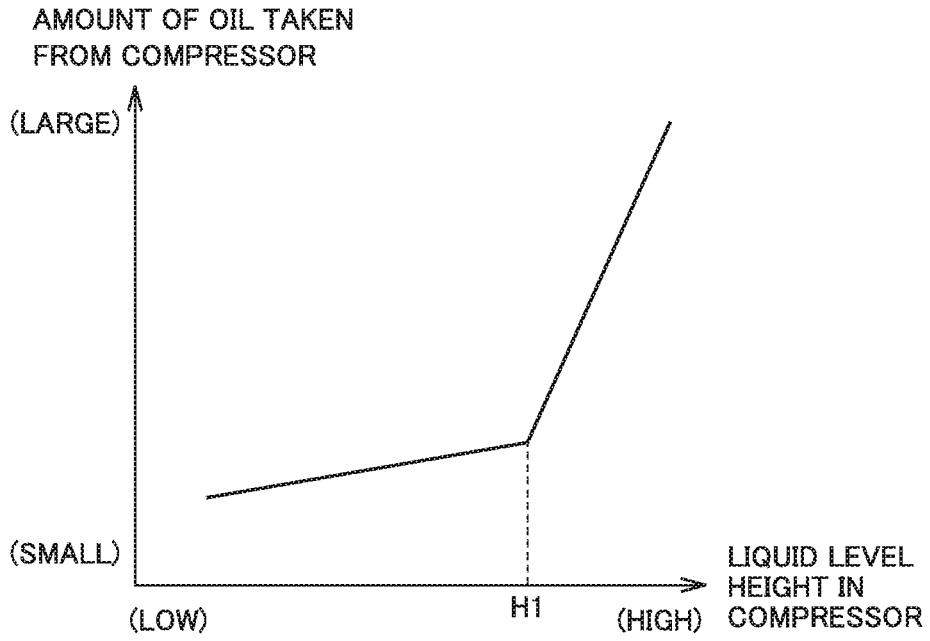
FIG. 2 is a diagram schematically showing a relation between a liquid level height in a compressor and an amount of oil taken from the compressor to a refrigerant circuit at the time of operation of the compressor.

FIG. 2 is a diagram schematically showing a relation between a liquid level height in compressor 10 and an amount of oil taken from compressor 10 to the refrigerant circuit at the time of operation of compressor 10. Referring to FIG. 2, when the liquid level in compressor 10 rises, the amount of oil (mixed liquid) taken from compressor 10 to the refrigerant circuit at the time of operation of compressor 10 increases. Although it depends on the type of compressor 10, there is generally an inflection point at which the amount of oil taken from compressor 10 increases sharply when the liquid level in compressor 10 exceeds a certain height H1. When compressor 10 is, for example, of rotary type, liquid level height H1 corresponds to a lower end of a motor portion, and when the liquid level of the mixed liquid in compressor 10 reaches the lower end of the motor portion, the amount of oil taken from compressor 10 to the refrigerant circuit increases sharply.

Figure 3:
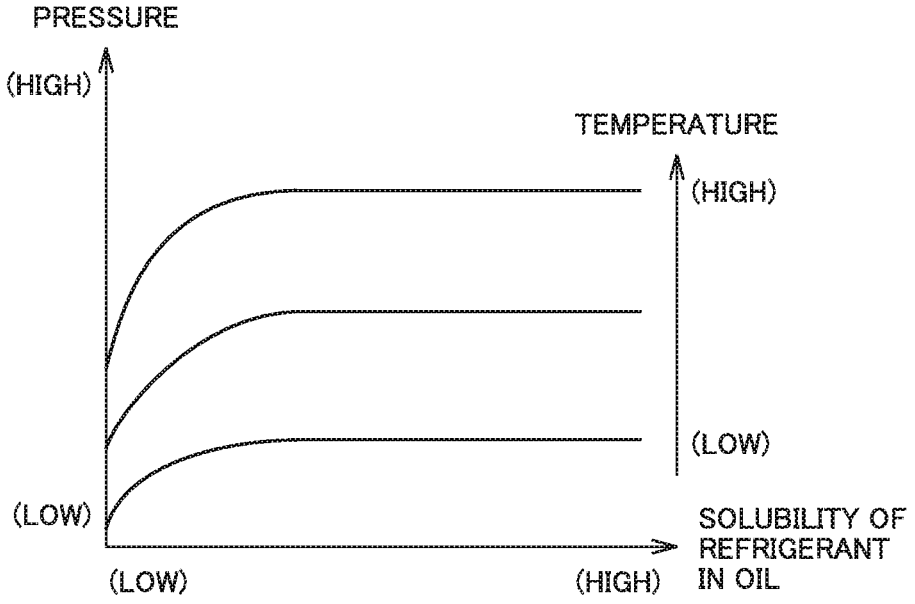
FIG. 3 is a diagram showing a solubility of refrigerant in a lubricating oil in the compressor.

FIG. 3 is a diagram showing a solubility of the refrigerant in the lubricating oil in compressor 10. Referring to FIG. 3, the horizontal axis represents the solubility of the refrigerant in the oil, and the vertical axis represents the pressure. When the temperature is low, the refrigerant dissolves in the oil even if the pressure is low. Therefore, while compressor 10 remains stopped, during which the temperature is lower than the temperature during operation of compressor 10, an amount of dissolution of the refrigerant in the oil in compressor 10 increases, and consequently, an oil concentration of the mixed liquid in compressor 10 decreases.

As described above, while compressor 10 remains stopped, the liquid level of the mixed liquid in compressor 10 rises and the oil concentration of the mixed liquid in compressor 10 also decreases. Therefore, when the operation of compressor 10 is started, the large amount of mixed liquid is taken from compressor 10 to the refrigerant circuit and the oil concentration in compressor 10 is also low, and thus, poor lubrication of compressor 10 may occur.

Thus, in refrigeration cycle apparatus 1 according to the first embodiment, in the case of stopping compressor 10, the control for increasing the degree of superheat at the outlet of evaporator 40 is executed. Specifically, in the first embodiment, control device 100 changes the opening degree of expansion valve 30 in the closing direction, to thereby increase the degree of superheat at the outlet of evaporator 40. When the opening degree of expansion valve 30 is changed in the closing direction, the pressure on the outlet side of expansion valve 30 decreases and the degree of dryness of the refrigerant increases. As a result, the degree of superheat at the outlet of evaporator 40 increases. By increasing the degree of superheat at the outlet of evaporator 40, an amount of oil staying in evaporator 40 can be increased. This will be described in more detail below.

Figure 4:
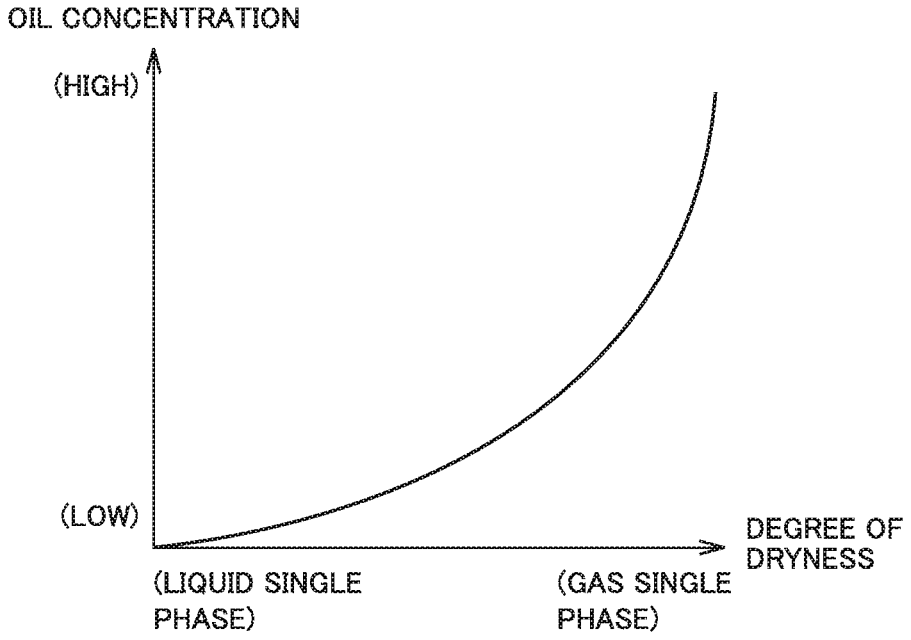
FIG. 4 is a diagram showing a relation between a degree of dryness of the refrigerant in which a mixed liquid is mixed and an oil concentration of the mixed liquid.
Figure 5:
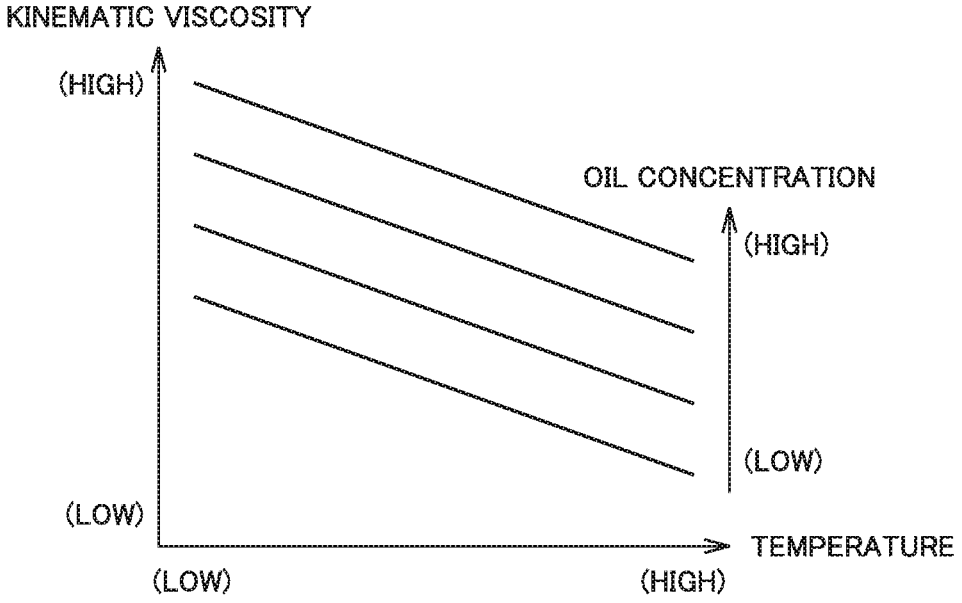
FIG. 5 is a diagram showing a relation between an oil concentration and a kinematic viscosity.

FIG. 4 is a diagram showing a relation between the degree of dryness of the refrigerant in which the mixed liquid is mixed and the oil concentration of the mixed liquid. Referring to FIG. 4, when the degree of dryness increases (a region of a gas single phase increases with respect to a liquid single phase), the oil concentration of the mixed liquid becomes higher. FIG. 5 is a diagram showing a relation between the oil concentration and a kinematic viscosity. Referring to FIG. 5, as the oil concentration of the mixed liquid becomes higher, the viscosity of the mixed liquid becomes higher. Therefore, based on FIGS. 4 and 5, when the degree of dryness is increased, the viscosity of the mixed liquid becomes higher.

Thus, by increasing the degree of superheat at the outlet of evaporator 40, the degree of dryness in evaporator 40 can be increased and the oil concentration and the oil viscosity in evaporator 40 can be increased. The increase in oil viscosity in evaporator 40 makes the mixed liquid less likely to flow in evaporator 40, and thus, the amount of oil staying in evaporator 40 increases. Control device 100 increases the degree of superheat at the outlet of evaporator 40 and thereby increases the amount of oil staying in evaporator 40 as described above, and then, stops compressor 10. Thus, the amount of oil returning to compressor 10 increases when the operation of compressor 10 is started next. As a result, oil depletion in compressor 10 is suppressed and the operational reliability of compressor 10 is improved.

(Description of Operation of Control Device 100)

Figure 6:
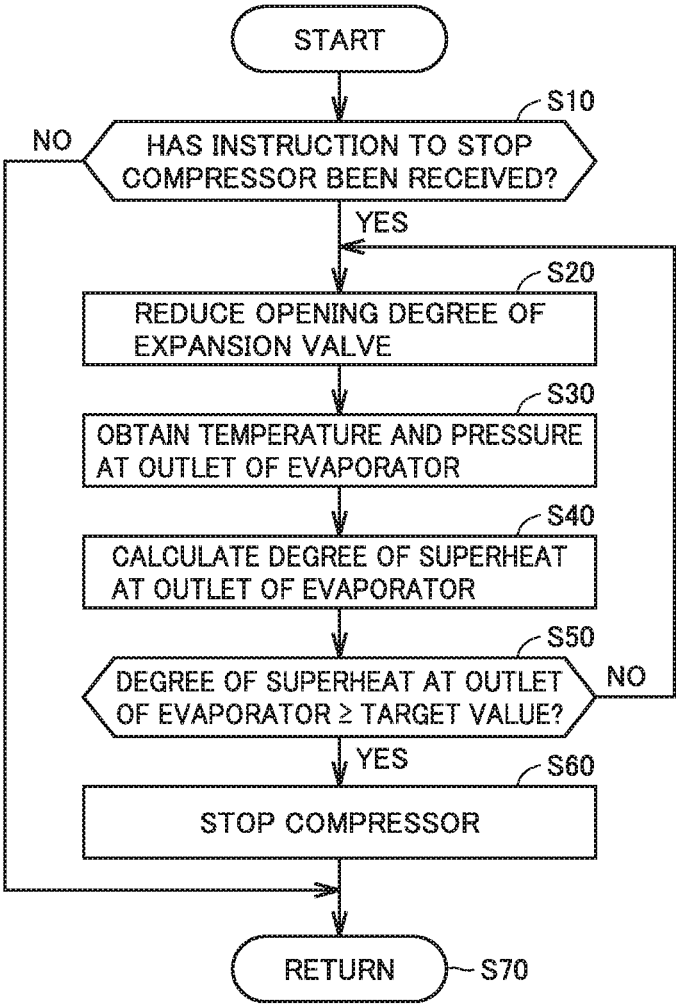
FIG. 6 is a flowchart showing a procedure of a process performed by a control device in the case of stopping the compressor.

FIG. 6 is a flowchart showing a procedure of a process performed by control device 100 in the case of stopping compressor 10. Referring to FIG. 1 together with FIG. 6, control device 100 determines whether or not an instruction to stop compressor 10 has been received (step S10). The instruction to stop compressor 10 may be generated by a stop operation by a user of refrigeration cycle apparatus 1, or may be generated by satisfaction of a stop condition. When it is determined that the instruction to stop compressor 10 has not been received (NO in step S10), control device 100 moves the process to step S70 without performing a series of subsequent steps.

When it is determined in step S10 that the instruction to stop compressor 10 has been received (YES in step S10), control device 100 reduces the opening degree of expansion valve 30 (step S20). Specifically, control device 100 does not fully close expansion valve 30 but changes the opening degree of expansion valve 30 in the closing direction by a certain amount. As a result, the degree of superheat at the outlet of evaporator 40 increases.

Next, control device 100 obtains the detection value of the temperature at the outlet of evaporator 40 from temperature sensor 54 provided at the outlet of evaporator 40. In addition, control device 100 obtains the detection value of the pressure at the outlet of evaporator 40 from pressure sensor 52 provided at the outlet of evaporator 40 (step S30). Then, control device 100 calculates the degree of superheat at the outlet of evaporator 40 based on the detection values of the pressure and the temperature at the outlet of evaporator 40 obtained in step S30 (step S40). As described above, the degree of superheat at the outlet of evaporator 40 is calculated by subtracting the saturation gas temperature estimated based on the pressure detection value from the temperature detection value.

Next, control device 100 determines whether or not the degree of superheat at the outlet of evaporator 40 calculated in step S40 is equal to or higher than a target value (step S50). This target value is set at a value that makes it possible to ensure a desired amount of the returning oil from evaporator 40 at the start of operation by increasing the degree of superheat at the outlet of evaporator 40, and may be preliminarily determined by an experiment and the like.

When it is determined in step S50 that the degree of superheat at the outlet of evaporator 40 is lower than the target value (NO in step S50), control device 100 returns the process to step S20 and the opening degree of expansion valve 30 is further reduced. On the other hand, when it is determined in step S50 that the degree of superheat at the outlet of evaporator 40 is equal to or higher than the target value (YES in step S50), control device 100 stops compressor 10 (step S60).

(Description of Flow of Refrigerant and Oil (Mixed Liquid))

Referring again to FIG. 1, a flow of the refrigerant and the oil (mixed liquid) generated by the operation of control device 100 described above will be described below. For comparison, a flow during normal operation (during operation that is neither immediately before stop nor immediately after the start of operation) will be described first.

<During Normal Operation>

The mixed liquid of the liquid refrigerant and the oil is output from compressor 10 to pipe 90 together with the high-temperature and high-pressure gas refrigerant (superheated vapor). The gas refrigerant and the mixed liquid flowing from pipe 90 into condenser 20 perform heat exchange (heat radiation) with the outdoor air in condenser 20. In condenser 20, the degree of dryness of the refrigerant decreases and the refrigerant is condensed to a liquid. The oil concentration of the mixed liquid decreases. The refrigerant and the mixed liquid output from condenser 20 to pipe 92 are decompressed by expansion valve 30 (isenthalpic expansion). The low-temperature and low-pressure gas refrigerant and the mixed liquid low in oil concentration are output from expansion valve 30, and flow through pipe 94 into evaporator 40. The gas refrigerant and the mixed liquid flowing into evaporator 40 perform heat exchange (heat absorption) with the outdoor air in evaporator 40. In evaporator 40, the degree of dryness of the refrigerant increases and the refrigerant changes to superheated vapor. The oil concentration of the mixed liquid increases. Then, the gas refrigerant and the mixed liquid output from evaporator 40 flow through pipe 96 into compressor 10 and the mixed liquid including the oil returns to compressor 10.

<When Compressor 10 Stops>

When the instruction to stop compressor 10 is provided, refrigeration cycle apparatus 1 enters an operation mode of increasing the degree of superheat at the outlet of evaporator 40, and the opening degree of expansion valve 30 is reduced. As a result, the degree of dryness in evaporator 40 increases and the region of the gas single phase increases. The oil concentration of the mixed liquid in evaporator 40 increases and the oil viscosity increases. The increase in oil viscosity of the mixed liquid in evaporator 40 makes the mixed liquid less likely to flow in evaporator 40, and thus, the amount of oil staying in evaporator 40 increases. When it is determined that the degree of superheat at the outlet of evaporator 40 is equal to or higher than the target value and a sufficient amount of oil stays in evaporator 40, compressor 10 stops.

While compressor 10 remains stopped, the oil stays in evaporator 40, and thus, the amount of oil in compressor 10 decreases. In addition, in compressor 10, the liquid refrigerant dissolves in the oil, and thus, the liquid level of the mixed liquid rises and the oil concentration decreases.

<When Operation of Compressor 10 is Started>

When the operation of compressor 10 is started, the mixed liquid low in oil concentration is taken to the refrigerant circuit together with the gas refrigerant. As a result, the liquid level in compressor 10 falls, and with the fall of the liquid level, the amount of mixed liquid taken to the refrigerant circuit also decreases. On the other hand, the mixed liquid high in oil concentration staying in evaporator 40 flows into compressor 10 (the amount of oil returning to compressor 10 increases). Therefore, since the amount of the taken mixed liquid decreases and the mixed liquid high in oil concentration flows into compressor 10, the oil concentration in compressor 10 increases. As a result, oil depletion in compressor 10 is suppressed and the operational reliability of compressor 10 is improved.

As described above, in the first embodiment, in the case of stopping compressor 10, the opening degree of expansion valve 30 is changed in the closing direction, to thereby increase the degree of superheat at the outlet of evaporator 40. As a result, the amount of oil staying in evaporator 40 increases, and then, compressor 10 stops. Therefore, according to the first embodiment, the amount of oil returning to compressor 10 can be increased at the start of operation of compressor 10. As a result, oil depletion in the compressor that may occur at the start of operation of the compressor can be suppressed and the operational reliability of the compressor can be improved.

[First Modification of First Embodiment]

In the first embodiment described above, in the case of stopping compressor 10, the opening degree of expansion valve 30 is changed in the closing direction, to thereby increase the degree of superheat at the outlet of evaporator 40. Instead, the operation frequency of compressor 10 may be increased in order to increase the degree of superheat at the outlet of evaporator 40. When the operation frequency of compressor 10 is increased, a flow rate of the refrigerant flowing to the refrigerant circuit increases and an amount of heat to be processed by evaporator 40 and condenser 20 increases. Therefore, an evaporation temperature of the refrigerant in evaporator 40 decreases and a condensation temperature of the refrigerant in condenser 20 increases. As a result, as compared with the state before the operation frequency of compressor 10 is increased, the amount of refrigerant moves to the condenser 20 side in the refrigerant circuit and the degree of dryness increases on the evaporator 40 side, and thus, the degree of superheat at the outlet of evaporator 40 increases.

Figure 7:
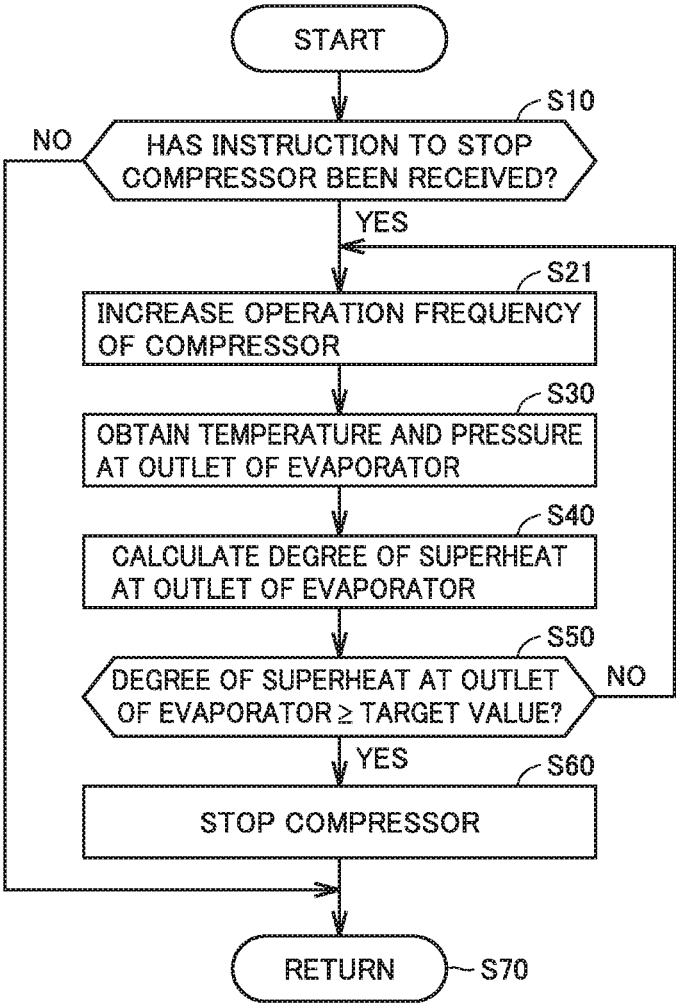
FIG. 7 is a flowchart showing a procedure of a process performed by the control device in the case of stopping the compressor in a first modification of the first embodiment.

FIG. 7 is a flowchart showing a procedure of a process performed by control device 100 in the case of stopping compressor 10 in a first modification of the first embodiment. Referring to FIG. 7, this flowchart includes step S21 instead of step S20 in the flowchart in the first embodiment shown in FIG. 6.

Namely, when it is determined in step S10 that the instruction to stop compressor 10 has been received (YES in step S10), control device 100 increases the operation frequency of compressor 10 (step S21). Specifically, control device 100 changes the operation frequency of compressor 10 in an increasing direction by a certain amount. As a result, the degree of superheat at the outlet of evaporator 40 increases. After step S21 is performed, control device 100 moves the process to step S30. The processing in the steps other than step S21 is identical to the processing in the flowchart shown in FIG. 6.

[Second Modification of First Embodiment]

In the first modification described above, the operation frequency of compressor 10 is increased in order to increase the degree of superheat at the outlet of evaporator 40. Instead, the rotation speed of evaporator fan 42 may be increased. When the rotation speed of evaporator fan 42 is increased, heat exchange between the refrigerant and mixed liquid and the outdoor air (heat absorption of the refrigerant and the mixed liquid) is promoted in evaporator 40. As a result, the degree of superheat at the outlet of evaporator 40 increases.

Figure 8:
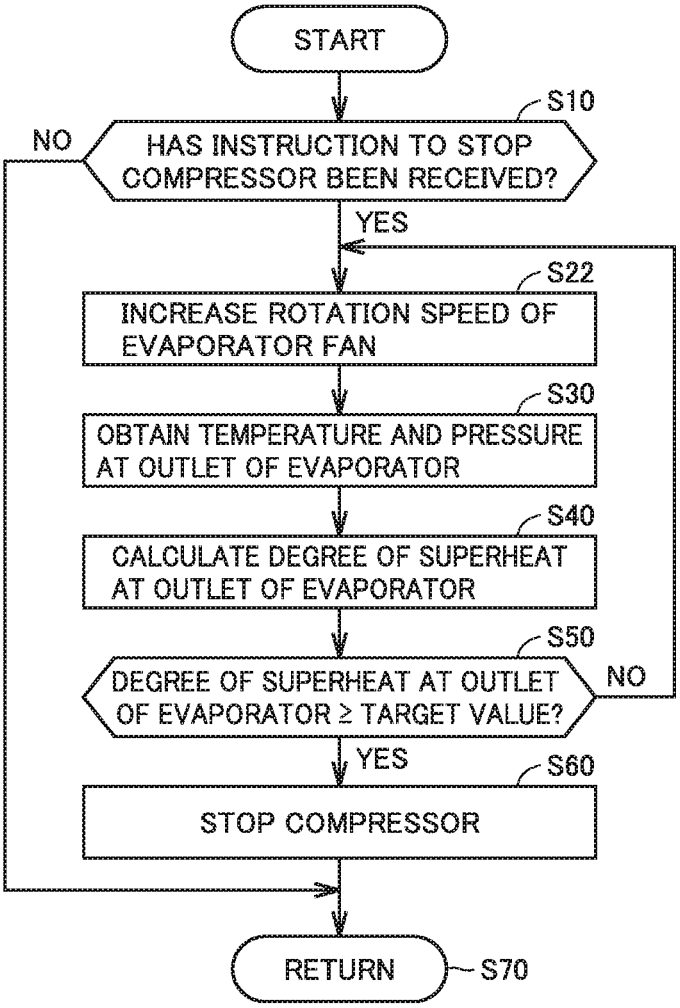
FIG. 8 is a flowchart showing a procedure of a process performed by the control device in the case of stopping the compressor in a second modification of the first embodiment.

FIG. 8 is a flowchart showing a procedure of a process performed by control device 100 in the case of stopping compressor 10 in a second modification of the first embodiment. Referring to FIG. 8, this flowchart includes step S22 instead of step S20 in the flowchart in the first embodiment shown in FIG. 6.

Namely, when it is determined in step S10 that the instruction to stop compressor 10 has been received (YES in step S10), control device 100 increases the rotation speed of evaporator fan 42 (step S22). Specifically, control device 100 changes the rotation speed of evaporator fan 42 in an increasing direction by a certain amount. As a result, the degree of superheat at the outlet of evaporator 40 increases. After step S22 is performed, control device 100 moves the process to step S30. The processing in the steps other than step S22 is identical to the processing in the flowchart shown in FIG. 6.

[Third Modification of First Embodiment]

In the first embodiment and the first and second modifications thereof described above, in the case of stopping compressor 10, the control for increasing the degree of superheat at the outlet of evaporator 40 is executed. In this third modification, the control for increasing the degree of superheat at the outlet of evaporator 40 is executed not only in the case of stopping compressor 10 but also at the start of operation of compressor 10. As a result, liquid back to compressor 10 at the start of operation of compressor 10 is suppressed.

Namely, when the liquefied refrigerant (liquid refrigerant) flows into compressor 10 (the liquid back occurs) at the start of operation of compressor 10, a malfunction of compressor 10 may occur. In addition, when the liquid back to compressor 10 occurs, the liquid level in compressor 10 rises and the oil concentration in compressor 10 decreases. Therefore, when the liquid back occurs at the start of operation of compressor 10, the possibility of occurrence of poor lubrication of compressor 10 described in the first embodiment becomes higher.

Thus, in refrigeration cycle apparatus 1 according to the third modification, the above-described control for increasing the degree of superheat at the outlet of evaporator 40 (the first embodiment or the first or second modifications thereof) is executed in the case of stopping compressor 10, and in addition, the above-described control for increasing the degree of superheat at the outlet of evaporator 40 is also executed at the start of operation of compressor 10. As a result, at the start of operation of compressor 10, the degree of superheat at the inlet of compressor 10 increases and the liquid back to compressor 10 is suppressed.

Figure 9:
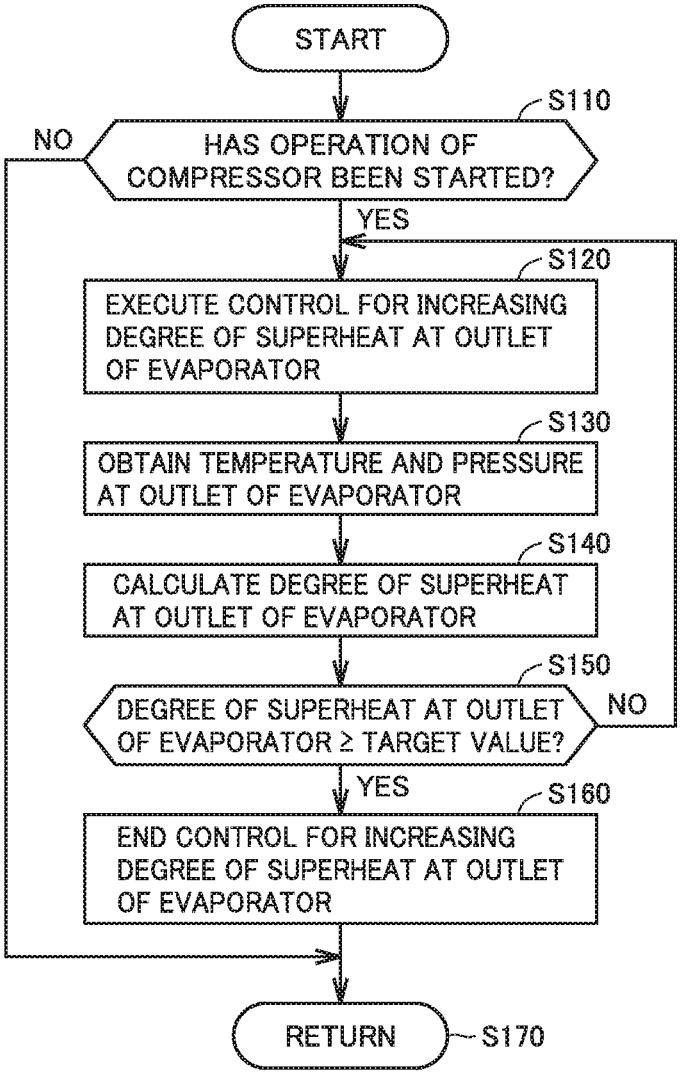
FIG. 9 is a flowchart showing a procedure of a process performed by the control device when the operation of the compressor starts.

FIG. 9 is a flowchart showing a procedure of a process performed by control device 100 when the operation of compressor 10 starts. Referring to FIG. 1 together with FIG. 9, control device 100 determines whether or not the operation of compressor 10 has been started (step S110). When the operation of compressor 10 has not been started (NO in step S110), control device 100 moves the process to step S170 without performing a series of subsequent steps.

When it is determined in step S110 that the operation of compressor 10 has been started (YES in step S110), control device 100 executes the control for increasing the degree of superheat at the outlet of evaporator 40 (step S120). Specifically, control device 100 may reduce the opening degree of expansion valve 30 (step S20 in FIG. 6), or may increase the operation frequency of compressor 10 (step S21 in FIG. 7), or may increase the rotation speed of evaporator fan 42 (step S22 in FIG. 8).

Next, control device 100 obtains the detection value of the temperature at the outlet of evaporator 40 from temperature sensor 54 provided at the outlet of evaporator 40. In addition, control device 100 obtains the detection value of the pressure at the outlet of evaporator 40 from pressure sensor 52 provided at the outlet of evaporator 40 (step S130). Then, control device 100 calculates the degree of superheat at the outlet of evaporator 40 based on the detection values of the pressure and the temperature at the outlet of evaporator 40 obtained in step S130 (step S140). Furthermore, control device 100 determines whether or not the degree of superheat at the outlet of evaporator 40 calculated in step S140 is equal to or higher than the target value (step S150). The processing in these steps S130 to S150 is identical to the processing in steps S30 to S50 shown in FIG. 6, respectively.

When it is determined in step S150 that the degree of superheat at the outlet of evaporator 40 is lower than the target value (NO in step S150), control device 100 returns the process to step S120 and the control for increasing the degree of superheat at the outlet of evaporator 40 is further executed. On the other hand, when it is determined in step S150 that the degree of superheat at the outlet of evaporator 40 is equal to or higher than the target value (YES in step S150), control device 100 ends the control for increasing the degree of superheat at the outlet of evaporator 40 (step S160).

As described above, in the third modification, the control for increasing the degree of superheat at the outlet of evaporator 40 is executed not only in the case of stopping compressor 10 but also at the start of operation of compressor 10. Therefore, according to the third modification, the liquid back to compressor 10 at the start of operation of compressor 10 can be suppressed.

Second Embodiment

In order to increase the degree of superheat at the outlet of evaporator 40 in the case of stopping compressor 10, the opening degree of expansion valve 30 is reduced in the first embodiment, the operation frequency of compressor 10 is increased in the first modification of the first embodiment, and the rotation speed of evaporator fan 42 is increased in the second modification of the first embodiment.

In this second embodiment, in the case of stopping compressor 10, a part of the high-temperature and high-pressure superheated vapor output from compressor 10 is directly supplied to the inlet side of evaporator 40. Thus, before compressor 10 is stopped, the degree of superheat at the outlet of evaporator 40 is increased and the mixed liquid high in oil concentration is supplied from compressor 10 to evaporator 40. As a result, the lubricating oil can stay in evaporator 40 when compressor 10 is stopped, and a sufficient amount of oil returning to compressor 10 can be ensured when the operation of compressor 10 is started.

Figure 10:
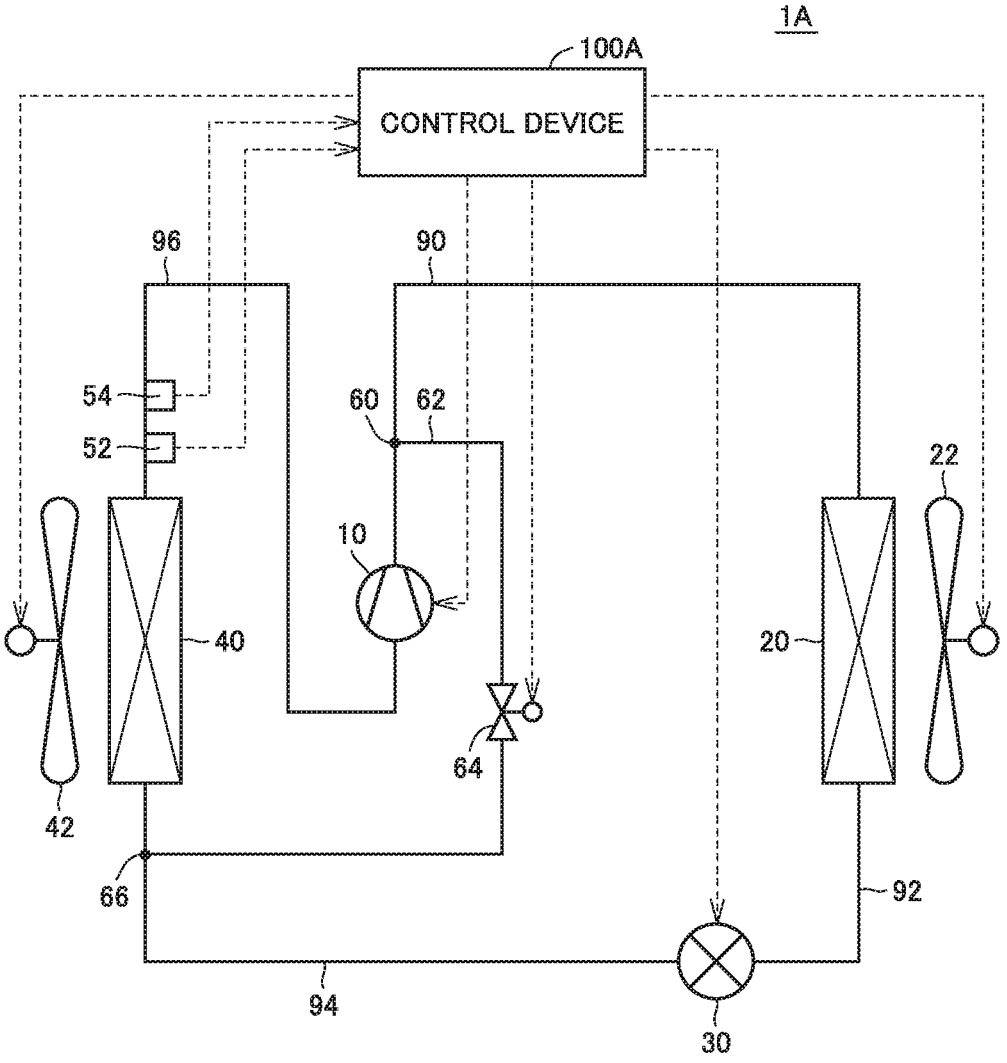
FIG. 10 is an overall configuration diagram of a refrigeration cycle apparatus according to a second embodiment.

FIG. 10 is an overall configuration diagram of a refrigeration cycle apparatus according to the second embodiment. Referring to FIG. 10, this refrigeration cycle apparatus 1A further includes a bypass pipe 62 and an adjusting valve 64, and includes a control device 100A instead of control device 100 in the configuration of refrigeration cycle apparatus 1 in the first embodiment shown in FIG. 1.

Bypass pipe 62 connects a branch portion 60 provided in pipe 90 and a merging portion 66 provided in pipe 94. Adjusting valve 64 is provided in bypass pipe 62 and is configured to be capable of adjusting an opening degree in accordance with a control signal received from control device 100. Adjusting valve 64 may be a simple valve that only performs the opening and closing operation.

In the case of stopping compressor 10, control device 100A executes the control for increasing the degree of superheat at the outlet of evaporator 40. Specifically, in the case of stopping compressor 10, control device 100A controls adjusting valve 64 from a closed state to an open state. Then, a part of the high-temperature and high-pressure gas refrigerant and the mixed liquid high in oil concentration output from compressor 10 are supplied from branch portion 60 of pipe 90 through bypass pipe 62 to merging portion 66 of pipe 94, and merge with the low-temperature and low-pressure gas refrigerant and the mixed liquid low in oil concentration output from expansion valve 30. As a result, the degree of superheat at the outlet of evaporator 40 increases and a part of the mixed liquid high in oil concentration taken from compressor 10 is supplied to evaporator 40. When the degree of superheat at the outlet of evaporator 40 increases to the target value, control device 100A stops compressor 10.

The remaining configuration of this refrigeration cycle apparatus 1A is identical to the configuration of refrigeration cycle apparatus 1 in the first embodiment shown in FIG. 1.

Figure 11:
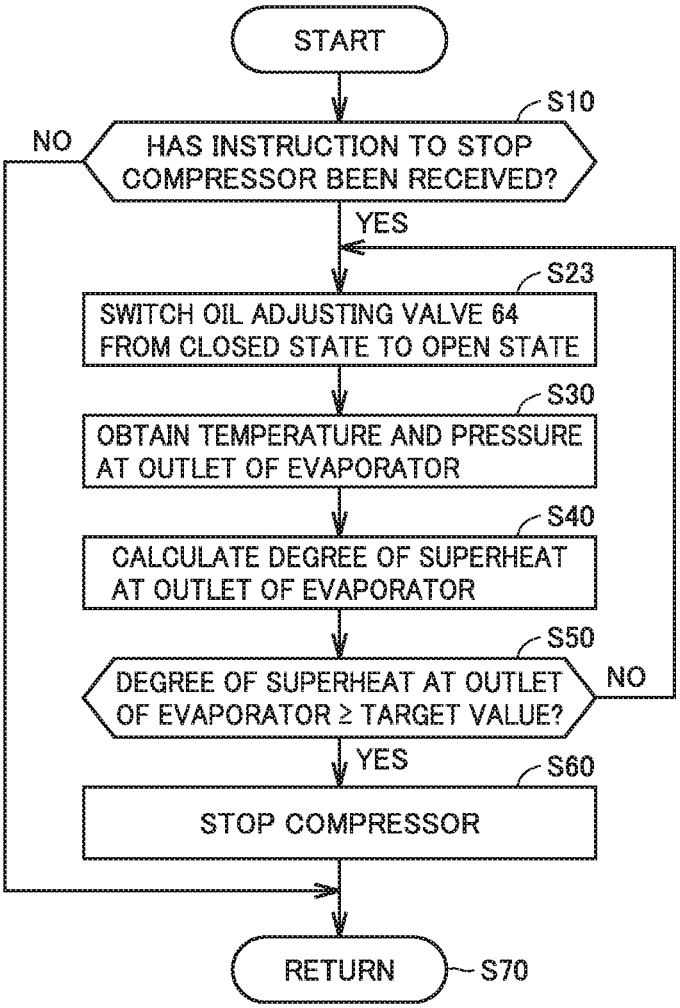
FIG. 11 is a flowchart showing a procedure of a process performed by a control device in the case of stopping a compressor in the second embodiment.

FIG. 11 is a flowchart showing a procedure of a process performed by control device 100A in the case of stopping compressor 10 in the second embodiment. Referring to FIG. 10 together with FIG. 11, this flowchart includes step S23 instead of step S20 in the flowchart in the first embodiment shown in FIG. 6.

Namely, when it is determined in step S10 that the instruction to stop compressor 10 has been received (YES in step S10), control device 100A switches adjusting valve 64 provided in bypass pipe 62 from the closed state to the open state (step S23). As a result, a part of the high-temperature and high-pressure gas refrigerant and the mixed liquid high in oil concentration output from compressor 10 are supplied to evaporator 40 and the degree of superheat at the outlet of evaporator 40 increases. After step S23 is performed, control device 100A moves the process to step S30. The processing in the steps other than step S23 is identical to the processing in the flowchart shown in FIG. 6.

(Description of Flow of Refrigerant and Oil (Mixed Liquid))

Referring again to FIG. 10, a flow of the refrigerant and the oil (mixed liquid) in refrigeration cycle apparatus 1A according to the second embodiment will be described below. During normal operation, adjusting valve 64 is closed. Therefore, during normal operation, a flow is not generated in bypass pipe 62, and thus, the flow of the refrigerant and the mixed liquid is identical to the flow during normal operation of refrigeration cycle apparatus 1 according to the first embodiment shown in FIG. 1.

<When Compressor 10 Stops>

When the instruction to stop compressor 10 is provided, refrigeration cycle apparatus 1A enters the operation mode of increasing the degree of superheat at the outlet of evaporator 40, and adjusting valve 64 is switched from the closed state to the open state. The high-temperature and high-pressure gas refrigerant and the mixed liquid high in oil concentration output from compressor 10 flow through pipe 90 into condenser 20, and a part thereof flow from branch portion 60 into bypass pipe 62. In merging portion 66 of pipe 94, the high-temperature and high-pressure gas refrigerant and the mixed liquid high in oil concentration flowing into bypass pipe 62 merge with the low-temperature and low-pressure gas refrigerant and the mixed liquid low in oil concentration output from expansion valve 30, and flow into evaporator 40. As a result, the degree of superheat at the outlet of evaporator 40 increases.

As described in the first embodiment, the increase in degree of superheat at the outlet of evaporator 40 results in the increase in amount of oil staying in evaporator 40. When it is determined that the degree of superheat at the outlet of evaporator 40 is equal to or higher than the target value and the sufficient amount of oil stays in evaporator 40, compressor 10 stops. As is also described in the first embodiment, while compressor 10 remains stopped, the liquid refrigerant dissolves in the oil in compressor 10, and thus, the liquid level of the mixed liquid rises and the oil concentration decreases.

<When Operation of Compressor 10 is Started>

When the operation of compressor 10 is started, the mixed liquid low in oil concentration is taken to the refrigerant circuit together with the gas refrigerant, and thus, the liquid level in compressor 10 falls. With the fall of the liquid level, the amount of mixed liquid taken to the refrigerant circuit decreases. On the other hand, the mixed liquid high in oil concentration staying in evaporator 40 flows into compressor 10. Therefore, since the amount of the taken mixed liquid decreases and the mixed liquid high in oil concentration flows into compressor 10, the oil concentration in compressor 10 increases. As a result, oil depletion in compressor 10 is suppressed and the operational reliability of compressor 10 is improved.

As described above, in the second embodiment, in the case of stopping compressor 10, a part of the high-temperature and high-pressure superheated vapor output from compressor 10 is directly supplied through bypass pipe 62 to the inlet side of evaporator 40. As a result, before compressor 10 is stopped, the degree of superheat at the outlet of evaporator 40 is increased and the mixed liquid high in oil concentration is supplied from compressor 10 to evaporator 40. Therefore, according to the second embodiment, the lubricating oil can stay in evaporator 40 when compressor 10 is stopped, and the sufficient amount of oil returning to compressor 10 can be ensured when the operation of compressor 10 is started.

[Modification of Second Embodiment]

In the second embodiment described above, bypass pipe 62 connecting pipe 90 and pipe 94 is provided and adjusting valve 64 is switched from the closed state to the open state in the case of stopping compressor 10. In addition to this, in this modification, adjusting valve 64 is also switched to the open state at the start of operation of compressor 10. As a result, at the start of operation of compressor 10, the liquid back to compressor 10 is suppressed and the amount of oil returning to compressor 10 increases.

Namely, since adjusting valve 64 is also switched to the open state at the start of operation of compressor 10, the degree of superheat at the outlet of evaporator 40 increases. As a result, the degree of superheat at the inlet of compressor 10 increases and the liquid back to compressor 10 is suppressed. In addition, since the mixed liquid taken from compressor 10 is supplied through bypass pipe 62 to evaporator 40, the amount of oil returning to compressor 10 at the start of operation of compressor 10 also increases. As described above, adjusting valve 64 is also switched to the open state at the start of operation of compressor 10, and thus, the liquid back to compressor 10 is suppressed and the amount of oil returning to compressor 10 is also ensured.

Figure 12:
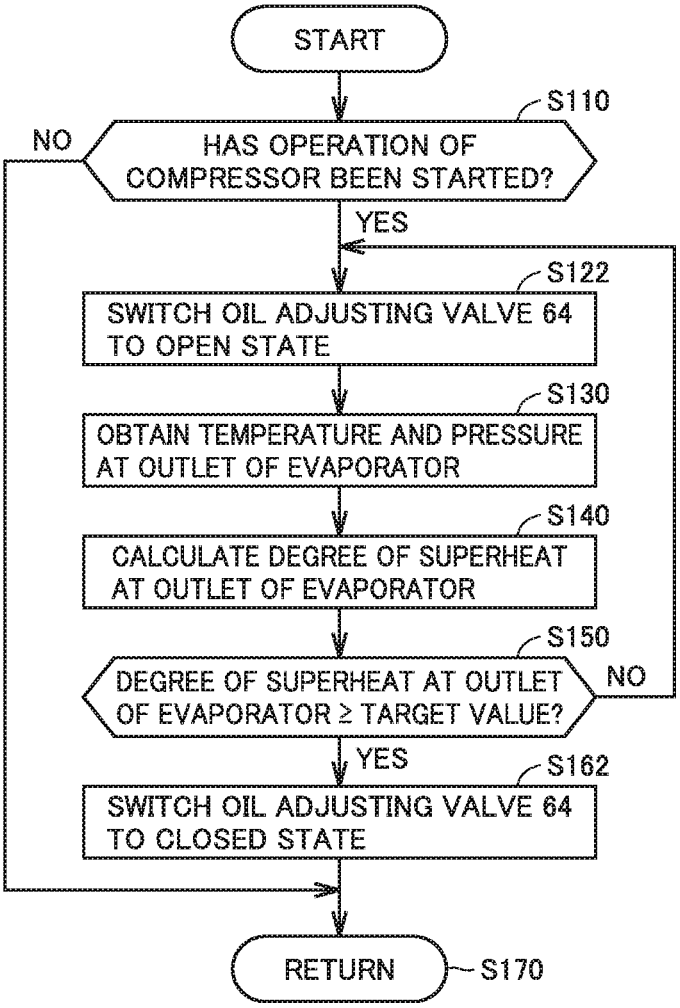
FIG. 12 is a flowchart showing a procedure of a process performed by the control device when the operation of the compressor starts in a modification of the second embodiment.

FIG. 12 is a flowchart showing a procedure of a process performed by control device 100A when the operation of compressor 10 starts in the modification of the second embodiment. Referring to FIG. 12, this flowchart includes steps S122 and S162 instead of steps S120 and S160, respectively, in the flowchart in the third modification of the first embodiment shown in FIG. 9.

Namely, when it is determined in step S110 that the operation of compressor 10 has been started (YES in step S110), control device 100A switches adjusting valve 64 provided in bypass pipe 62 from the closed state to the open state (step S122). As a result, as described above, the liquid back to compressor 10 is suppressed and the amount of oil returning to compressor 10 also increases. After step S122 is performed, control device 100A moves the process to step S130.

In addition, when it is determined in step S150 that the degree of superheat at the outlet of evaporator 40 is equal to or higher than the target value (YES in step S150), control device 100A switches adjusting valve 64 provided in bypass pipe 62 to the closed state (step S162).

The processing in the steps other than steps S122 and S162 is identical to the processing in the flowchart shown in FIG. 9.

According to the modification of the second embodiment, at the start of operation of compressor 10, the liquid back to compressor 10 can be suppressed and the amount of oil returning to compressor 10 can be increased.

Third Embodiment

In this third embodiment, in the case of stopping compressor 10, heat exchange is performed between the high-temperature and high-pressure gas refrigerant and mixed liquid output from compressor 10 and the low-temperature and low-pressure gas refrigerant and mixed liquid output from expansion valve 30. Thus, the degree of dryness of the gas refrigerant and the mixed liquid flowing into evaporator 40 increases and the degree of superheat at the outlet of evaporator 40 increases. As a result, the lubricating oil can stay in evaporator 40 when compressor 10 is stopped, and the amount of oil returning to compressor 10 can be increased when the operation of compressor 10 is started.

Figure 13:
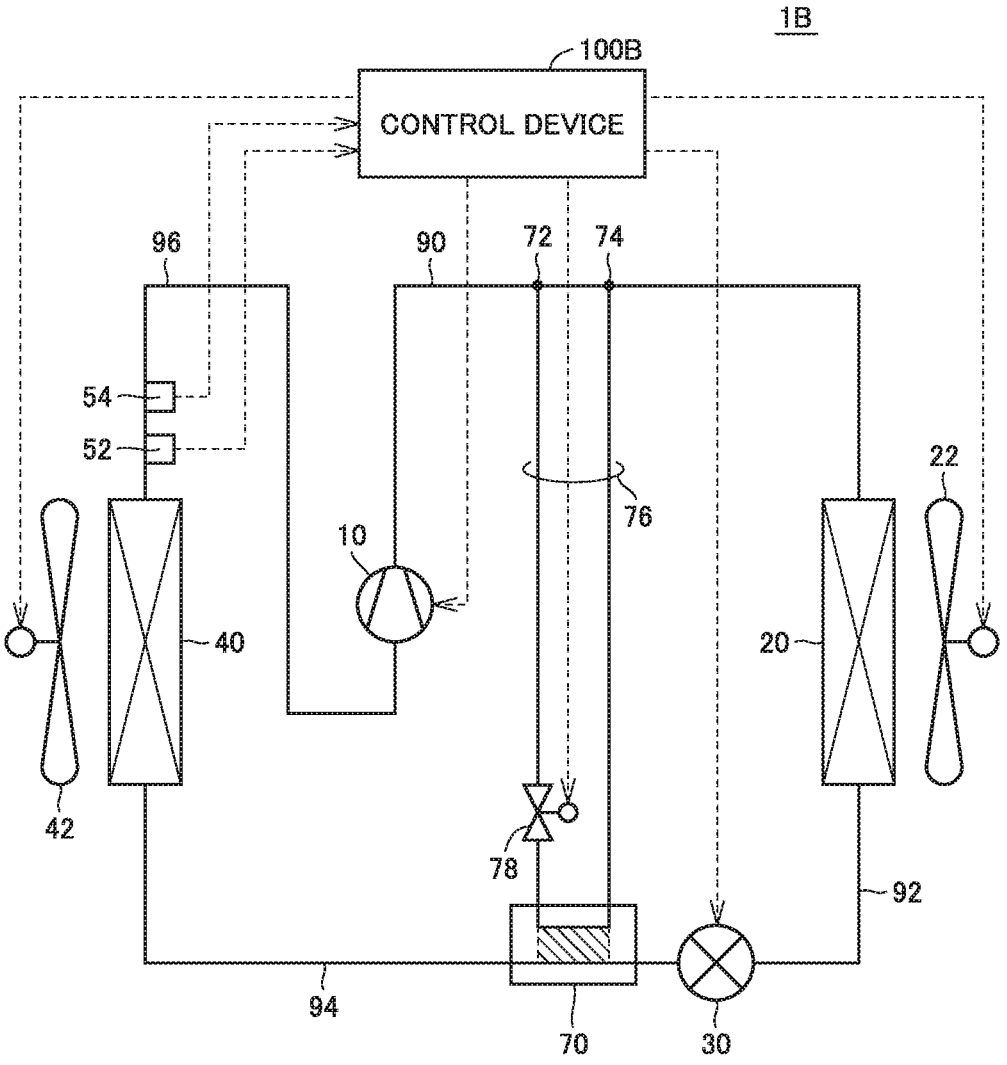
FIG. 13 is an overall configuration diagram of a refrigeration cycle apparatus according to a third embodiment.

FIG. 13 is an overall configuration diagram of a refrigeration cycle apparatus according to the third embodiment. Referring to FIG. 13, this refrigeration cycle apparatus 1B further includes an internal heat exchanger 70, a branch pipe 76 and an adjusting valve 78, and includes a control device 100B instead of control device 100, in the configuration of refrigeration cycle apparatus 1 in the first embodiment shown in FIG. 1.

Internal heat exchanger 70 is configured to perform heat exchange between the high-temperature and high-pressure gas refrigerant and mixed liquid output from compressor 10 and the low-temperature and low-pressure gas refrigerant and mixed liquid output from expansion valve 30. In the third embodiment, as one example, internal heat exchanger 70 is provided in pipe 94 and performs heat exchange between the high-temperature and high-pressure gas refrigerant and mixed liquid flowing through branch pipe 76 that branches off from pipe 90 and the low-temperature and low-pressure gas refrigerant and mixed liquid flowing through pipe 94.

Branch pipe 76 is configured to branch off from a branch portion 72 of pipe 90 and be connected to a merging portion 74 (provided closer to condenser 20 than branch portion 72) of pipe 90 via internal heat exchanger 70. Adjusting valve 78 is provided in branch pipe 76 and is configured to be capable of adjusting an opening degree in accordance with a control signal received from control device 100B. Adjusting valve 78 may be a simple valve that only performs the opening and closing operation.

In the case of stopping compressor 10, control device 100B executes the control for increasing the degree of superheat at the outlet of evaporator 40. Specifically, in the case of stopping compressor 10, control device 100B controls adjusting valve 78 from the closed state to the open state. Then, a part of the high-temperature and high-pressure gas refrigerant and the mixed liquid output from compressor 10 is supplied from branch portion 72 of pipe 90 through branch pipe 76 to internal heat exchanger 70, and performs heat exchange with the low-temperature and low-pressure gas refrigerant and the mixed liquid output from expansion valve 30.

As a result of heat absorption in internal heat exchanger 70, the low-temperature and low-pressure gas refrigerant and the mixed liquid output from expansion valve 30 increase in degree of dryness and flows into evaporator 40.

As a result, the degree of superheat at the outlet of evaporator 40 increases and the amount of oil staying in evaporator 40 increases. When the degree of superheat at the outlet of evaporator 40 increases to the target value, control device 100B stops compressor 10.

The remaining configuration of this refrigeration cycle apparatus 1B is identical to the configuration of refrigeration cycle apparatus 1 in the first embodiment shown in FIG. 1.

Figure 14:
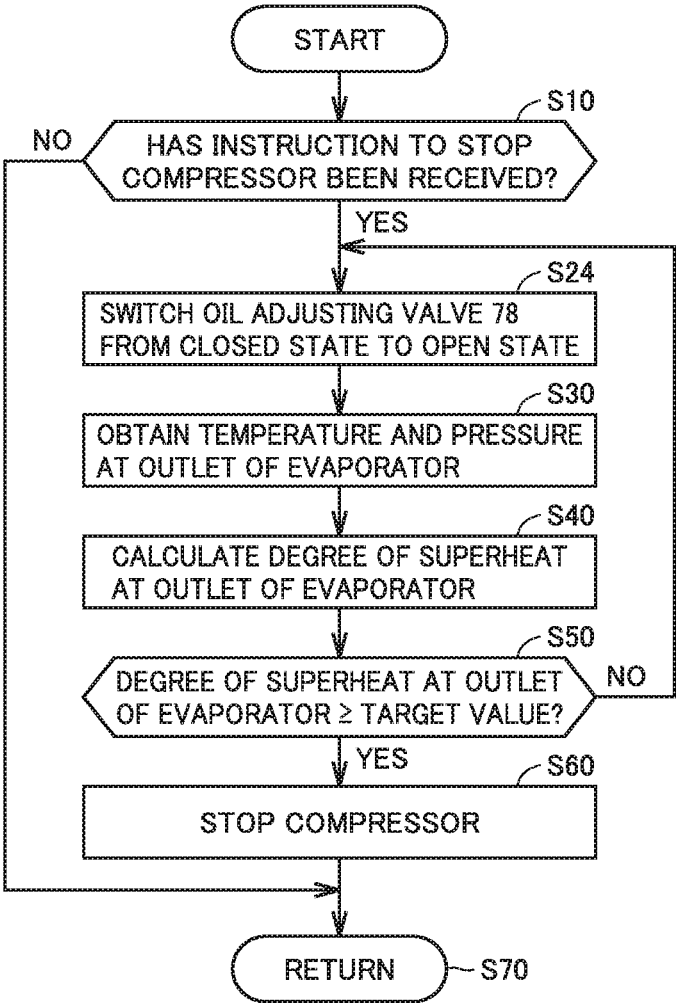
FIG. 14 is a flowchart showing a procedure of a process performed by a control device in the case of stopping a compressor in the third embodiment.

FIG. 14 is a flowchart showing a procedure of a process performed by control device 100B in the case of stopping compressor 10 in the third embodiment. Referring to FIG. 13 together with FIG. 14, this flowchart includes step S24 instead of step S20 in the flowchart in the first embodiment shown in FIG. 6.

Namely, when it is determined in step S10 that the instruction to stop compressor 10 has been received (YES in step S10), control device 100B switches adjusting valve 78 provided in branch pipe 76 from the closed state to the open state (step S24). As a result, heat exchange is performed in internal heat exchanger 70 and the degree of superheat at the outlet of evaporator 40 increases as described above. After step S24 is performed, control device 100B moves the process to step S30. The processing in the steps other than step S24 is identical to the processing in the flowchart shown in FIG. 6.

(Description of Flow of Refrigerant and Oil (Mixed Liquid))

Referring again to FIG. 13, a flow of the refrigerant and the oil (mixed liquid) in refrigeration cycle apparatus 1B according to the third embodiment will be described below. During normal operation, adjusting valve 78 is closed. Therefore, during normal operation, a flow is not generated in branch pipe 76, and thus, the flow of the refrigerant and the mixed liquid is identical to the flow during normal operation of refrigeration cycle apparatus 1 according to the first embodiment shown in FIG. 1.

<When Compressor 10 Stops>

When the instruction to stop compressor 10 is provided, refrigeration cycle apparatus 1B enters the operation mode of increasing the degree of superheat at the outlet of evaporator 40, and adjusting valve 78 is switched from the closed state to the open state. The high-temperature and high-pressure gas refrigerant and the mixed liquid output from compressor 10 flows through pipe 90 into condenser 20, and a part thereof flows through branch pipe 76 into internal heat exchanger 70. As a result of heat exchange (heat absorption) in internal heat exchanger 70, the low-temperature and low-pressure gas refrigerant and the mixed liquid output from expansion valve 30 flow into evaporator 40 with the degree of dryness being high. As a result, the degree of superheat at the outlet of evaporator 40 increases.

As a result of heat exchange (heat radiation) in internal heat exchanger 70, the high-temperature and high-pressure gas refrigerant and the mixed liquid output from compressor 10 flow into condenser 20 with the degree of dryness being low. Thus, the amount of oil staying in condenser 20 decreases, and consequently, the amount of oil flowing into evaporator 40 increases. Therefore, this also contributes to the increase in amount of oil staying in evaporator 40.

As described in the first embodiment, the increase in degree of superheat at the outlet of evaporator 40 results in the increase in amount of oil staying in evaporator 40. When it is determined that the degree of superheat at the outlet of evaporator 40 is equal to or higher than the target value and the sufficient amount of oil stays in evaporator 40, compressor 10 stops.

<When Operation of Compressor 10 is Started>

As described in the first embodiment, when the operation of compressor 10 is started, the mixed liquid high in oil concentration staying in evaporator 40 flows into compressor 10, and thus, the oil concentration in compressor 10 increases. As a result, oil depletion in compressor 10 is suppressed and the operational reliability of compressor 10 is improved.

An adjusting valve may be further provided between branch portion 72 and merging portion 74 in pipe 90, and the above-described adjusting valve may be closed when adjusting valve 78 provided in branch pipe 76 is opened, and the above-described adjusting valve may be opened when adjusting valve 78 is closed. As a result, a total amount of the high-temperature and high-pressure gas refrigerant and the mixed liquid output from compressor 10 can flow through internal heat exchanger 70 and an amount of heat exchange in internal heat exchanger 70 can be increased.

In addition, in the foregoing description, internal heat exchanger 70 is provided in pipe 94 and branch pipe 76 is provided in pipe 90. Instead, internal heat exchanger 70 may be provided in pipe 90 and the branch pipe may be provided in pipe 94. Alternatively, a branch pipe connected to internal heat exchanger 70 may be provided in each of pipes 90 and 94, without providing internal heat exchanger 70 in pipes 90 and 94.

As described above, in the third embodiment, internal heat exchanger 70 is provided, and thus, the degree of superheat at the outlet of evaporator 40 can be increased. In addition, by virtue of internal heat exchanger 70, the amount of oil staying in condenser 20 can be decreased and the amount of oil flowing into evaporator 40 can be increased. As a result, in the case of stopping compressor 10, the amount of oil staying in evaporator 40 can be effectively increased. Therefore, according to the third embodiment, at the start of operation of compressor 10, the sufficient amount of oil returning to compressor 10 can be ensured. As a result, oil depletion in the compressor that may occur at the start of operation of the compressor can be suppressed and the operational reliability of the compressor can be improved.

[Modification of Third Embodiment]

In the third embodiment described above, branch pipe 76 is provided and adjusting valve 78 is switched from the closed state to the open state in the case of stopping compressor 10. In addition to this, in this modification, adjusting valve 78 is also switched to the open state at the start of operation of compressor 10. As a result, the liquid back to compressor 10 at the start of operation of compressor 10 is Suppressed.

Namely, adjusting valve 78 is also switched to the open state at the start of operation of compressor 10, and thus, the degree of superheat at the outlet of evaporator 40 increases. As a result, the degree of superheat at the inlet of compressor 10 increases and the liquid back to compressor 10 is suppressed.

Figure 15:
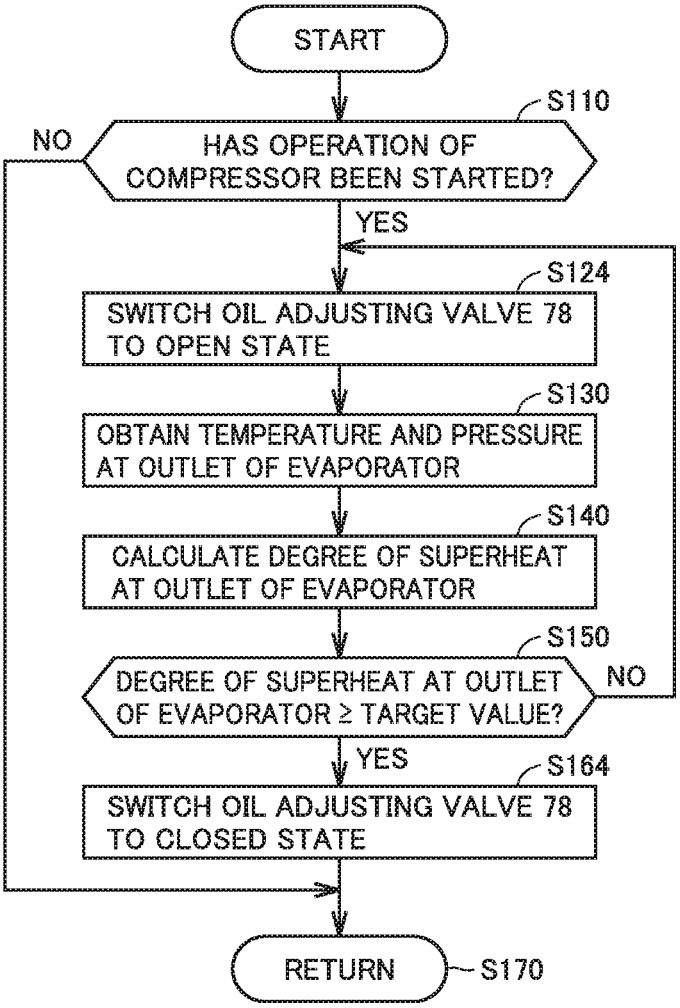
FIG. 15 is a flowchart showing a procedure of a process performed by the control device when the operation of the compressor starts in a modification of the third embodiment.

FIG. 15 is a flowchart showing a procedure of a process performed by control device 100B when the operation of compressor 10 starts in the modification of the third embodiment. Referring to FIG. 15, this flowchart includes steps S124 and S164 instead of steps S120 and S160, respectively, in the flowchart in the third modification of the first embodiment shown in FIG. 9.

Namely, when it is determined in step S110 that the operation of compressor 10 has been started (YES in step S110), control device 100B switches adjusting valve 78 provided in branch pipe 76 from the closed state to the open state (step S124). As a result, the liquid back to compressor 10 is suppressed as described above. After step S124 is performed, control device 100B moves the process to step S130.

In addition, when it is determined in step S150 that the degree of superheat at the outlet of evaporator 40 is equal to or higher than the target value (YES in step S150), control device 100B switches adjusting valve 78 provided in branch pipe 76 to the closed state (step S164).

The processing in the steps other than steps S124 and S164 is identical to the processing in the flowchart shown in FIG. 9.

According to the modification of the third embodiment, at the start of operation of compressor 10, the amount of oil returning to compressor 10 can be increased and the liquid back to compressor 10 can be suppressed.

Fourth Embodiment

In this fourth embodiment, an oil separator is provided in pipe 90 to which the high-temperature and high-pressure gas refrigerant and the mixed liquid high in oil concentration are output from compressor 10, and in the case of stopping compressor 10, the high-temperature and high-pressure mixed liquid high in oil concentration separated by the oil separator is supplied to the inlet side of evaporator 40. Thus, before compressor 10 is stopped, the degree of superheat at the outlet of evaporator 40 is increased and the mixed liquid high in oil concentration is supplied from the oil separator to evaporator 40. As a result, the lubricating oil can stay in evaporator 40 when compressor 10 is stopped, and the sufficient amount of oil returning to compressor 10 can be ensured when the operation of compressor 10 is started.

Figure 16:
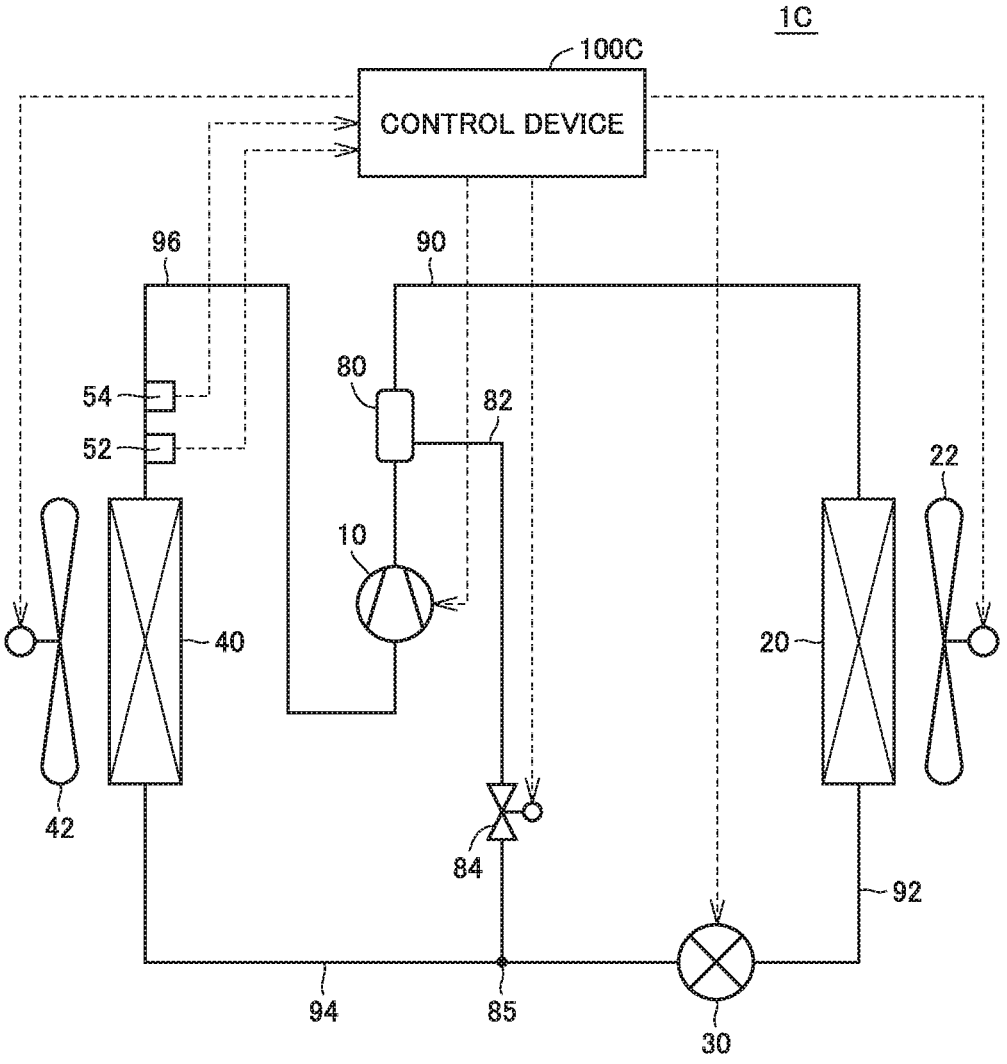
FIG. 16 is an overall configuration diagram of a refrigeration cycle apparatus according to a fourth embodiment.

FIG. 16 is an overall configuration diagram of a refrigeration cycle apparatus according to the fourth embodiment. Referring to FIG. 16, this refrigeration cycle apparatus 1C further includes an oil separator 80, an oil returning pipe 82 and an adjusting valve 84, and includes a control device 100C instead of control device 100, in the configuration of refrigeration cycle apparatus 1 in the first embodiment shown in FIG. 1.

Oil separator 80 is provided in pipe 90 and separates the high-temperature and high-pressure gas refrigerant and the mixed liquid high in oil concentration output from compressor 10. Oil returning pipe 82 connects oil separator 80 and a merging portion 85 provided in pipe 94. Adjusting valve 84 is provided in oil returning pipe 82 and is configured to be capable of adjusting an opening degree in accordance with a control signal received from control device 100C. Adjusting valve 84 may be a simple valve that only performs the opening and closing operation.

The high-temperature and high-pressure gas refrigerant separated by oil separator 80 is output to pipe 90. The mixed liquid high in oil concentration separated from the gas refrigerant in oil separator 80 is supplied through oil returning pipe 82 to merging portion 85 of pipe 94 when adjusting valve 84 is open.

In the case of stopping compressor 10, control device 100C executes the control for increasing the degree of superheat at the outlet of evaporator 40. Specifically, in the case of stopping compressor 10, control device 100C controls adjusting valve 84 from the closed state to the open state. Then, the mixed liquid high in oil concentration separated by oil separator 80 is supplied from oil separator 80 through oil returning pipe 82 to merging portion 85 of pipe 94, and merges with the low-temperature and low-pressure gas refrigerant and the mixed liquid low in oil concentration output from expansion valve 30. As a result, the degree of superheat at the outlet of evaporator 40 increases and the mixed liquid high in oil concentration taken from compressor 10 is supplied to evaporator 40. When the degree of superheat at the outlet of evaporator 40 increases to the target value, control device 100C stops compressor 10.

The remaining configuration of this refrigeration cycle apparatus 1C is identical to the configuration of refrigeration cycle apparatus 1 in the first embodiment shown in FIG. 1.

Figure 17:
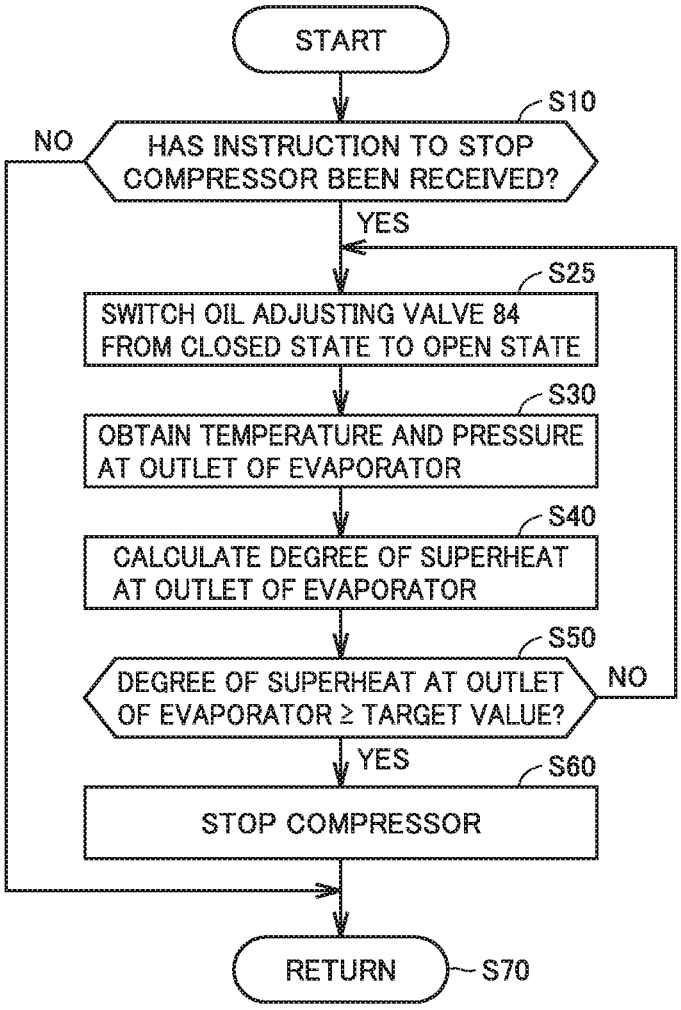
FIG. 17 is a flowchart showing a procedure of a process performed by a control device in the case of stopping a compressor in the fourth embodiment.

FIG. 17 is a flowchart showing a procedure of a process performed by control device 100C in the case of stopping compressor 10 in the fourth embodiment. Referring to FIG. 16 together with FIG. 17, this flowchart includes step S25 instead of step S20 in the flowchart in the first embodiment shown in FIG. 6.

Namely, when it is determined in step S10 that the instruction to stop compressor 10 has been received (YES in step S10), control device 100C switches adjusting valve 84 provided in oil returning pipe 82 from the closed state to the Open state (step S25). As a result, the high-temperature and high-pressure mixed liquid separated by oil separator 80 is supplied to evaporator 40 and the degree of superheat at the outlet of evaporator 40 increases. After step S25 is performed, control device 100C moves the process to step S30. The processing in the steps other than step S25 is identical to the processing in the flowchart shown in FIG. 6, (Description of Flow of Refrigerant and Oil (Mixed Liquid))

Referring again to FIG. 16, a flow of the refrigerant and the oil (mixed liquid) in refrigeration cycle apparatus 1C according to the fourth embodiment will be described below. During normal operation, adjusting valve 84 is closed. Therefore, during normal operation, a flow is not generated in oil returning pipe 82 and the flow of the refrigerant and the mixed liquid is identical to the flow during normal operation of refrigeration cycle apparatus 1 in the first embodiment shown in FIG. 1.

<When Compressor 10 Stops>

When the instruction to stop compressor 10 is provided, refrigeration cycle apparatus 1C enters the operation mode of increasing the degree of superheat at the outlet of evaporator 40, and adjusting valve 84 is switched from the closed state to the open state. Then, the mixed liquid separated from the gas refrigerant in oil separator 80 flows from oil separator 80 into oil returning pipe 82. In merging portion 85 of pipe 94, the high-temperature and high-pressure mixed liquid high in oil concentration flowing into oil returning pipe 82 merges with the low-temperature and low-pressure gas refrigerant and the mixed liquid low in oil concentration output from expansion valve 30, and flows into evaporator 40. As a result, the degree of superheat at the outlet of evaporator 40 increases.

As described in the first embodiment, the increase in degree of superheat at the outlet of evaporator 40 results in the increase in amount of oil staying in evaporator 40. When it is determined that the degree of superheat at the outlet of evaporator 40 is equal to or higher than the target value and the sufficient amount of oil stays in evaporator 40, compressor 10 stops. As is also described in the first embodiment, while compressor 10 remains stopped, the liquid refrigerant dissolves in the oil in compressor 10, and thus, the liquid level of the mixed liquid rises and the oil concentration decreases.

<When Operation of Compressor 10 is Started>

As described in the first embodiment, when the operation of compressor 10 is started, the mixed liquid high in oil concentration staying in evaporator 40 flows into compressor 10 and thus the oil concentration in compressor 10 increases. As a result, oil depletion in compressor 10 is suppressed and the operational reliability of compressor 10 is improved.

As described above, in the fourth embodiment, in the case of stopping compressor 10, the high-temperature and high-pressure mixed liquid high in oil concentration separated by oil separator 80 is directly supplied through oil returning pipe 82 to the inlet side of evaporator 40. As a result, before compressor 10 is stopped, the degree of superheat at the outlet of evaporator 40 is increased and the mixed liquid high in oil concentration separated by oil separator 80 is supplied to evaporator 40. Therefore, according to the fourth embodiment, the lubricating oil can stay in evaporator 40 when compressor 10 is stopped, and the sufficient amount of oil returning to compressor 10 can be ensured when the operation of compressor 10 is started.

[First Modification of Fourth Embodiment]

In the fourth embodiment described above, oil separator 80 and oil returning pipe 82 are provided, and adjusting valve 84 is switched from the closed state to the open state in the case of stopping compressor 10. In addition to this, in this first modification, adjusting valve 84 is also switched to the open state at the start of operation of compressor 10. As a result, at the start of operation of compressor 10, the liquid back to compressor 10 is suppressed and the amount of oil returning to compressor 10 increases.

Namely, adjusting valve 84 is also switched to the open state at the start of operation of compressor 10, and thus, the degree of superheat at the outlet of evaporator 40 increases. As a result, the degree of superheat at the inlet of compressor 10 increases and the liquid back to compressor 10 is suppressed. In addition, since the mixed liquid high in oil concentration separated by oil separator 80 is supplied through oil returning pipe 82 to evaporator 40, the amount of oil returning to compressor 10 at the start of operation of compressor 10 also increases. As described above, adjusting valve 84 is also switched to the open state at the start of operation of compressor 10, and thus, the liquid back to compressor 10 is suppressed and the amount of oil returning to compressor 10 is also ensured.

Figure 18:
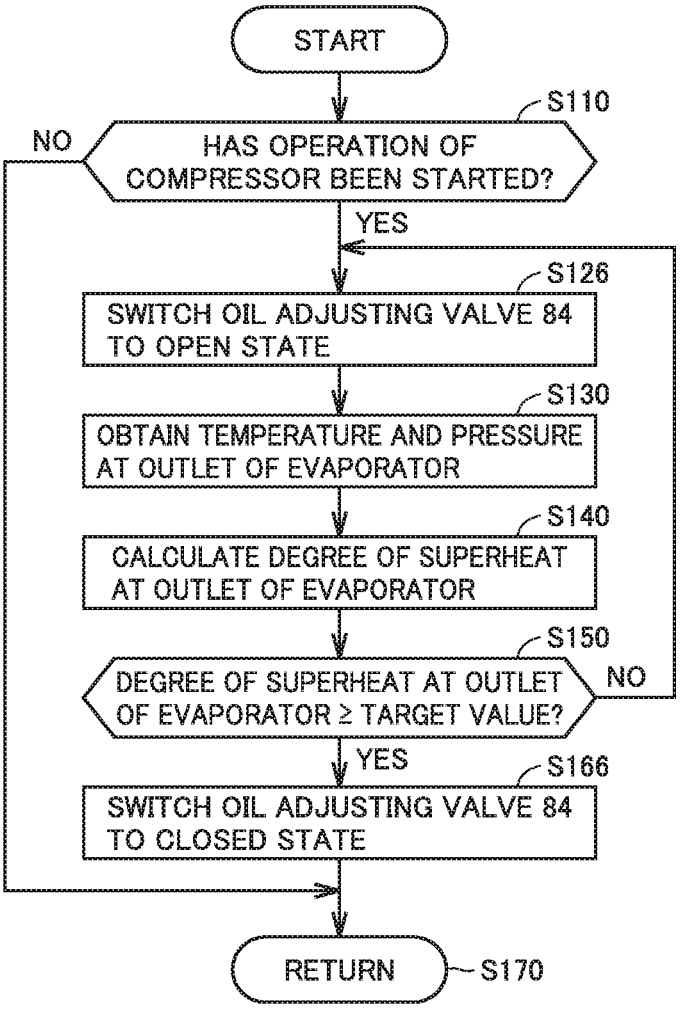
FIG. 18 is a flowchart showing a procedure of a process performed by the control device when the operation of the compressor starts in a first modification of the fourth embodiment.

FIG. 18 is a flowchart showing a procedure of a process performed by control device 100C when the operation of compressor 10 starts in the first modification of the fourth embodiment. Referring to FIG. 18, this flowchart includes steps S126 and S166 instead of steps S120 and S160, respectively, in the flowchart in the third modification of the first embodiment shown in FIG. 9.

Namely, when it is determined in step S110 that the operation of compressor 10 has been started (YES in step S110), control device 100C switches adjusting valve 84 provided in oil returning pipe 82 from the closed state to the open state (step S126). As a result, the liquid back to compressor 10 is suppressed and the amount of oil returning to compressor 10 also increases as described above. After step S126 is performed, control device 100C moves the process to step S130.

In addition, when it is determined in step S150 that the degree of superheat at the outlet of evaporator 40 is equal to or higher than the target value (YES in step S150), control device 100C switches adjusting valve 84 provided in oil returning pipe 82 to the closed state (step S166).

The processing in the steps other than steps S126 and S166 is identical to the processing in the flowchart shown in FIG. 9.

According to the first modification of the fourth embodiment, at the start of operation of compressor 10, the liquid back to compressor 10 can be suppressed and the amount of oil returning to compressor 10 can be increased.

[Second Modification of Fourth Embodiment]

In the fourth embodiment and the first modification thereof described above, the mixed liquid high in oil concentration separated by oil separator 80 is supplied through oil returning pipe 82 to the inlet side of evaporator 40. Instead, in this second modification, the mixed liquid high in oil concentration separated by oil separator 80 is directly returned to compressor 10. As a result, the amount of oil taken to the refrigerant circuit can be reduced and the operational reliability of compressor 10 can be improved.

Figure 19:
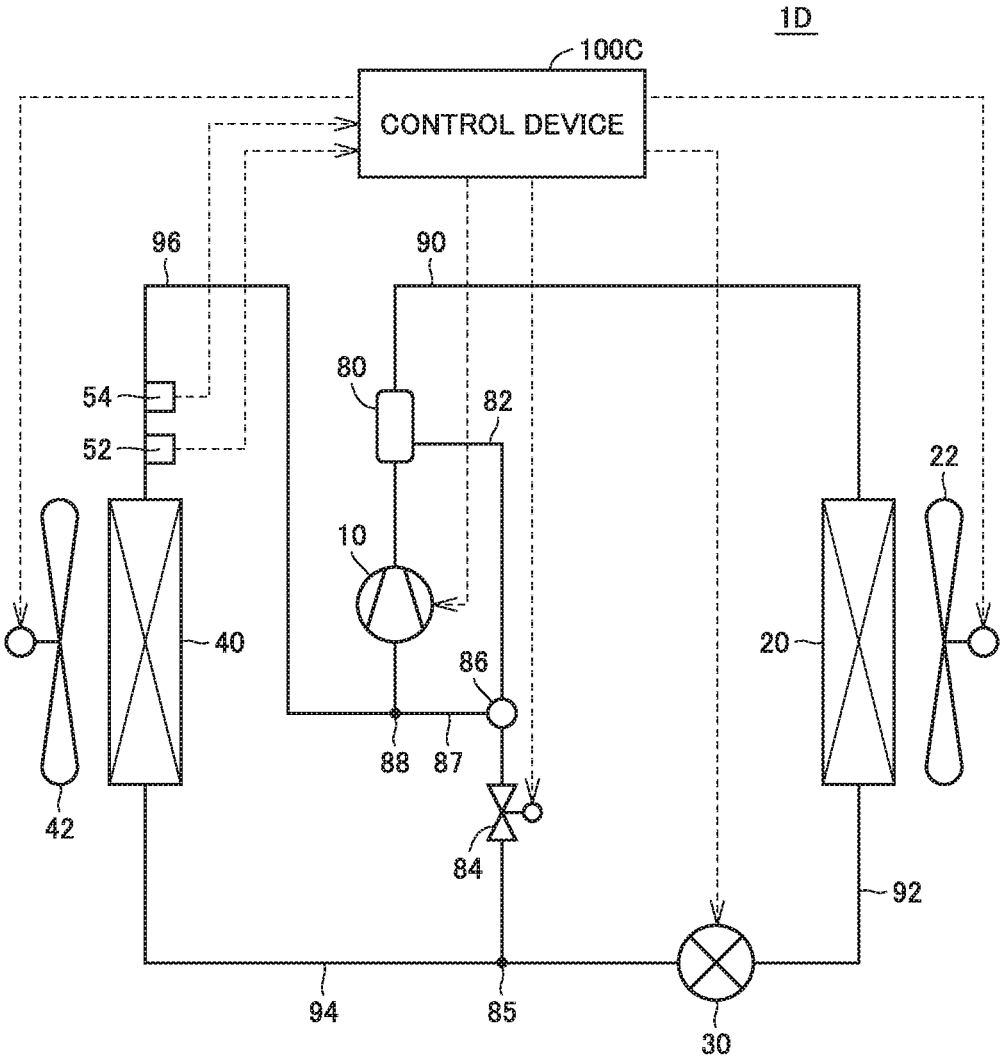
FIG. 19 is an overall configuration diagram of a refrigeration cycle apparatus according to a second modification of the fourth embodiment.

FIG. 19 is an overall configuration diagram of a refrigeration cycle apparatus 1D according to the second modification of the fourth embodiment. Referring to FIG. 19, this refrigeration cycle apparatus 1D further includes a branch portion 86, a bypass pipe 87 and a merging portion 88 in the configuration of refrigeration cycle apparatus 1C shown in FIG. 16.

Branch portion 86 is provided between oil separator 80 and adjusting valve 84 in oil returning pipe 82. Bypass pipe 87 connects branch portion 86 and merging portion 88 provided in pipe 96. Since such bypass pipe 87 is provided, the mixed liquid separated by oil separator 80 is returned to compressor 10 through oil returning pipe 82, branch portion 86, bypass pipe 87, and merging portion 88 during normal operation in which adjusting valve 84 is closed. In addition, as described in the fourth embodiment and the first modification thereof mentioned above, a part of the mixed liquid separated by oil separator 80 is also returned to compressor 10 through bypass pipe 87 when adjusting valve 84 is opened.

Therefore, according to the second modification of the fourth embodiment, the amount of oil taken to the refrigerant circuit is reduced and the sufficient lubricity of compressor 10 is ensured, and thus, the operational reliability of compressor 10 can be improved.

In each of the embodiments and the modifications described above, a four-way valve for supplying the refrigerant and the mixed liquid output from compressor 10 to evaporator 40 and returning the refrigerant and the mixed liquid output from condenser 20 to compressor 10 may be provided on the outlet side of compressor 10, and the four-way valve may be switched as appropriate in accordance with selection from the heating operation, the cooling operation and the defrosting operation.

Each of the embodiments and the modifications described above can be practiced in combination as appropriate. By combining some embodiments or modifications, the degree of superheat at the outlet of evaporator 40 can be immediately increased and the amount of oil staying in evaporator 40 can be immediately increased in the case of stopping compressor 10. In addition, at the start of operation of compressor 10, the liquid back can be more reliably suppressed and the amount of oil returning to compressor 10 can also be further increased.

It should be understood that the embodiments disclosed herein are illustrative and non-restrictive in every respect. The scope of the present invention is defined by the terms of the claims, rather than the description of the embodiments above, and is intended to include any modifications within the scope and meaning equivalent to the terms of the claims.

REFERENCE SIGNS LIST

1, 1A to 1D refrigeration cycle apparatus; 10 compressor; 20 condenser; 22 condenser fan; 30 expansion valve; 40 evaporator; 42 evaporator fan; 52 pressure sensor; 54 temperature sensor; 60, 72, 86 branch portion; 62, 87 bypass pipe; 64, 78, 84 adjusting valve; 66, 74, 85, 88 merging portion; 70 internal heat exchanger; 76 branch pipe; 80 oil separator; 82 oil returning pipe; 90 to 96 pipe; 100, 100A to 100C control device.

The invention claimed is:

1. A refrigeration cycle apparatus comprising:

a compressor configured to compress refrigerant;

a condenser configured to condense the refrigerant output from the compressor;

an expansion valve configured to decompress the refrigerant output from the condenser;

an evaporator configured to evaporate the refrigerant output from the expansion valve for output to the compressor;

a controller configured to execute, when stopping the compressor in operation, control for increasing a degree of superheat of the refrigerant output from the evaporator to the compressor and then to stop the compressor;

a bypass pipe connecting a first pipe and a second pipe, the first pipe being configured to supply the refrigerant output from the compressor to the condenser, the second pipe being configured to supply the refrigerant output from the expansion valve to the evaporator; and an adjusting valve provided in the bypass pipe, wherein the control comprises control for switching the adjusting valve from a closed state to an open state.

2. The refrigeration cycle apparatus according to claim 1, wherein the controller is further configured to execute the control when operation of the compressor starts.

3. A refrigeration cycle apparatus comprising:

a compressor configured to compress refrigerant;

a condenser configured to condense the refrigerant output from the compressor;

an expansion valve configured to decompress the refrigerant output from the condenser;

an evaporator configured to evaporate the refrigerant output from the expansion valve for output to the compressor;

a controller configured to execute, when stopping the compressor in operation, control for increasing a degree of superheat of the refrigerant output from the evaporator to the compressor and then to stop the compressor;

an internal heat exchanger configured to perform heat exchange between the refrigerant output from the compressor and the refrigerant output from the expansion valve;

a branch pipe branching off from at least one of a first pipe and a second pipe, and connected to the internal heat exchanger, the first pipe being configured to supply the refrigerant output from the compressor to the condenser, the second pipe being configured to supply the refrigerant output from the expansion valve to the evaporator; and an adjusting valve provided in the branch pipe, wherein the control comprises control for switching the adjusting valve from a closed state to an open state.

4. The refrigeration cycle apparatus according to claim 3, wherein the controller is further configured to execute the control when operation of the compressor starts.

5. A refrigeration cycle apparatus comprising:

a compressor configured to compress refrigerant;

a condenser configured to condense the refrigerant output from the compressor;

an expansion valve configured to decompress the refrigerant output from the condenser;

an evaporator configured to evaporate the refrigerant output from the expansion valve for output to the compressor;

a controller configured to execute control for increasing a degree of superheat of the refrigerant output from the evaporator to the compressor, and then to stop the compressor;

an oil separator provided in a first pipe, the first pipe being configured to supply the refrigerant output from the compressor to the condenser;

a third pipe connecting the oil separator and a second pipe, and configured to output a lubricating oil separated by the oil separator to the second pipe, the second pipe being configured to supply the refrigerant output from the expansion valve to the evaporator; and an adjusting valve provided in the third pipe, wherein the control comprises control for switching the adjusting valve from a closed state to an open state.

6. The refrigeration cycle apparatus according to claim 5, further comprising a bypass pipe connecting a portion of the third pipe and a fourth pipe, the portion being located between the oil separator and the adjusting valve, the fourth pipe being configured to supply the refrigerant output from the evaporator to the compressor.

7. The refrigeration cycle apparatus according to claim 6, wherein the controller is further configured to execute the control when operation of the compressor starts.

8. The refrigeration cycle apparatus according to claim 5, wherein the controller is further configured to execute the control when operation of the compressor starts.

* * * * *